US009978251B2

(12) United States Patent
Gonia et al.

(10) Patent No.: US 9,978,251 B2
(45) Date of Patent: May 22, 2018

(54) WIRELESS LOCATION-BASED SYSTEM AND METHOD FOR DETECTING HAZARDOUS AND NON-HAZARDOUS CONDITIONS

(75) Inventors: Patrick Gonia, Maplewood, MN (US); Soumitri Kolavennu, Blaine, MN (US)

(73) Assignee: Honeywell International Inc., Morris Plains, NJ (US)

( * ) Notice: Subject to any disclaimer, the term of this patent is extended or adjusted under 35 U.S.C. 154(b) by 1371 days.

(21) Appl. No.: 12/695,736

(22) Filed: Jan. 28, 2010

(65) Prior Publication Data

US 2011/0161885 A1 Jun. 30, 2011

Related U.S. Application Data

(60) Provisional application No. 61/290,262, filed on Dec. 28, 2009.

(51) Int. Cl.
*G08B 19/00* (2006.01)
*G08B 25/00* (2006.01)
(Continued)

(52) U.S. Cl.
CPC ..... *G08B 25/009* (2013.01); *G08B 17/10* (2013.01); *G08B 21/12* (2013.01); *G08B 21/14* (2013.01); *G08B 25/10* (2013.01); *G08B 25/14* (2013.01)

(58) Field of Classification Search
CPC ..... G08B 21/14; G08B 17/00; G08B 21/16; G08B 25/009; G08B 25/016; G08B 7/062;
(Continued)

(56) References Cited

U.S. PATENT DOCUMENTS 5,060,308 A * 10/1991 Bieback ..... 398/133
5,568,121 A * 10/1996 Lamensdorf ..... 340/539.17
(Continued)

FOREIGN PATENT DOCUMENTS

AU 2015385701 A1 10/2017
BR PI1105634 A2 7/2015
(Continued)

OTHER PUBLICATIONS

EP Search Report for EP application No. EP 10 19 3394 dated Apr. 5, 2011.
(Continued)

*Primary Examiner* — Emily C Terrell
(74) *Attorney, Agent, or Firm* — Wick Phillips Gould & Martin, LLP

(57) ABSTRACT

A wireless location-based gas detection system and method includes a gas detector for wirelessly detecting location information associated with a hazardous gas event. The gas detector includes one or more remote gas sensors that monitor for the occurrence of a gas event and wirelessly communicates information with respect to the location of the event in association with time information to a server or location manager. A wireless communication device in association with one or more location anchor points periodically and under event conditions, transmits the location information and the gas concentration level. A location engine calculates an estimated location of the gas detector based on information received from the wireless communication device and provides the location data to the location manager. The location manager records the gas concentration level, the estimated location, and the time information and stores this information within a database. A graphical user interface is provided for visualizing the current and historical information.

28 Claims, 14 Drawing Sheets

(51) Int. Cl.

| | |
|---|---|
| ***G08B 17/10*** | (2006.01) |
| ***G08B 21/14*** | (2006.01) |
| ***G08B 25/10*** | (2006.01) |
| ***G08B 25/14*** | (2006.01) |
| ***G08B 21/12*** | (2006.01) |

(58) Field of Classification Search

CPC .... G08B 7/066; G08B 21/22; G08B 21/0269; G08B 21/0283; G08B 25/003; G08B 25/10; G08B 31/00; G08B 13/2454; G08B 21/02; G08B 21/0211; G08B 21/0213; G08B 21/0225; G08B 21/0227; G08B 21/028; G08B 21/0288; G08B 21/0294; G08B 21/12; G08B 25/14; G08B 29/186; G08B 7/06; G08B 17/117; G08B 19/00; G08B 19/005; G08B 21/0453; G08B 21/0476; G08B 21/0484; G08B 21/10; G08B 26/003; G08B 27/001; G08B 29/145; G08B 5/36; G08B 17/11; G08B 29/188; H04W 4/22; A62B 9/006; A62B 99/00; G01N 15/0272; H04L 12/1895

USPC ..... 340/521, 532, 539.13, 18, 22, 26

See application file for complete search history.

(56) References Cited

U.S. PATENT DOCUMENTS

| | | | | |
|---|---|---|---|---|
| 5,767,390 | A | 6/1998 | Chapman, IV | 73/40.7 |
| 5,771,004 | A | 6/1998 | Suppelsa et al. | 340/632 |
| 5,922,943 | A | 7/1999 | Chapman, IV | 73/40.7 |
| 6,053,030 | A | 4/2000 | Whynall et al. | |
| 6,114,964 | A * | 9/2000 | Fasano | 340/632 |
| 6,138,512 | A | 10/2000 | Roberts et al. | 73/570 |
| 6,182,497 | B1 | 2/2001 | Krajci | 73/23.2 |
| 6,198,390 | B1 * | 3/2001 | Schlager et al. | 340/540 |
| 6,252,510 | B1 | 6/2001 | Dungan | 340/632 |
| 6,415,646 | B1 | 7/2002 | Kessel et al. | |
| 6,670,887 | B2 * | 12/2003 | Dungan | 340/632 |
| 6,772,071 | B2 | 8/2004 | Gilbert et al. | 702/23 |
| 6,885,299 | B2 * | 4/2005 | Cooper et al. | 340/539.26 |
| 7,019,637 | B1 | 3/2006 | Johnson et al. | |
| 7,080,544 | B2 * | 7/2006 | Stepanik et al. | 73/31.02 |
| 7,091,852 | B2 * | 8/2006 | Mason et al. | 340/539.13 |
| 7,191,097 | B1 * | 3/2007 | Lee et al. | 702/183 |
| 7,221,928 | B2 * | 5/2007 | Laird et al. | 455/404.1 |
| 7,292,189 | B2 | 11/2007 | Orr et al. | |
| 7,345,582 | B2 | 3/2008 | Gould | |
| 7,483,917 | B2 * | 1/2009 | Sullivan et al. | |
| 7,522,043 | B2 | 4/2009 | English et al. | |
| 7,528,711 | B2 * | 5/2009 | Kates | 340/506 |
| 7,605,696 | B2 * | 10/2009 | Quatro | 340/539.13 |
| 7,609,159 | B2 | 10/2009 | Benson et al. | |
| 7,688,198 | B2 * | 3/2010 | Amidi | 340/539.13 |
| 7,848,732 | B2 * | 12/2010 | Thomas | 455/404.1 |
| 7,874,198 | B2 * | 1/2011 | Groves | 73/31.01 |
| 7,904,244 | B2 | 3/2011 | Sugla | |
| 7,934,412 | B2 | 5/2011 | Prince | |
| 7,994,926 | B2 | 8/2011 | Longman et al. | |
| 8,099,130 | B1 | 1/2012 | Halla et al. | |
| 8,350,693 | B2 * | 1/2013 | McSheffrey et al. | 340/531 |
| 8,400,317 | B2 | 3/2013 | Johnson, Jr. et al. | |
| 8,442,801 | B2 | 5/2013 | Gonla et al. | |
| 8,560,645 | B2 | 10/2013 | Linden et al. | |
| 8,885,559 | B2 | 11/2014 | Schmidt et al. | |
| 9,612,195 | B1 | 4/2017 | Friedman | |
| 2002/0008625 | A1 * | 1/2002 | Adams et al. | 340/573.1 |
| 2003/0214410 | A1 * | 11/2003 | Johnson et al. | 340/573.4 |
| 2004/0056771 | A1 | 3/2004 | Dungan | |
| 2004/0149918 | A1 | 8/2004 | Craig et al. | |
| 2004/0203904 | A1 | 10/2004 | Gwon et al. | |
| 2004/0204915 | A1 | 10/2004 | Steinthal et al. | |
| 2004/0215532 | A1 | 10/2004 | Boman et al. | 705/28 |
| 2005/0057370 | A1 | 3/2005 | Warrior et al. | |
| 2006/0082462 | A1 * | 4/2006 | Crook | 340/632 |
| 2007/0008099 | A1 | 1/2007 | Kimmel et al. | |
| 2007/0050157 | A1 * | 3/2007 | Kahn et al. | 702/55 |
| 2007/0168127 | A1 | 7/2007 | Zaruba et al. | |
| 2008/0122641 | A1 | 5/2008 | Amidi | |
| 2008/0130604 | A1 | 6/2008 | Boyd | |
| 2008/0168826 | A1 | 7/2008 | Saidi et al. | |
| 2009/0139299 | A1 | 6/2009 | Prince | 73/1.06 |
| 2009/0188302 | A1 | 7/2009 | Rolff et al. | 73/40.7 |
| 2009/0212995 | A1 | 8/2009 | Wu et al. | |
| 2010/0081411 | A1 * | 4/2010 | Montenero | 455/404.2 |
| 2011/0037599 | A1 | 2/2011 | Johnson, Jr. et al. | |
| 2011/0161044 | A1 | 6/2011 | Gonia et al. | |
| 2011/0251800 | A1 * | 10/2011 | Wilkins | 702/24 |
| 2012/0280818 | A1 | 11/2012 | Johnson, Jr. et al. | |
| 2012/0310547 | A1 | 12/2012 | Cristoforo | |
| 2013/0260792 | A1 | 10/2013 | Johnson, Jr. et al. | |
| 2013/0328697 | A1 | 12/2013 | Lundy | |
| 2013/0331028 | A1 | 12/2013 | Kuehnel et al. | |
| 2014/0031082 | A1 | 1/2014 | Zishaan | |
| 2014/0162692 | A1 | 6/2014 | Li et al. | |
| 2014/0253326 | A1 | 9/2014 | Cho et al. | |
| 2014/0254549 | A1 | 9/2014 | Lee et al. | |
| 2014/0349707 | A1 | 11/2014 | Bang | |
| 2015/0075256 | A1 | 3/2015 | Basham et al. | |
| 2015/0177208 | A1 | 6/2015 | Murphy | |
| 2016/0334378 | A1 | 11/2016 | Maddila et al. | |
| 2016/0381440 | A1 | 12/2016 | Davis | |
| 2017/0339741 | A1 | 11/2017 | K et al. | |

FOREIGN PATENT DOCUMENTS

| | | | |
|---|---|---|---|
| CA | 2760872 | A1 | 6/2012 |
| CN | 101361321 | A | 2/2009 |
| CN | 101983515 | A | 3/2011 |
| CN | 202082628 | U | 12/2011 |
| CN | 102937610 | A | 2/2013 |
| CN | 102608564 | B | 4/2016 |
| CN | 107005806 | A | 8/2017 |
| EP | 2339556 | A1 | 6/2011 |
| EP | 1929455 | B1 | 12/2011 |
| EP | 2461176 | B1 | 10/2016 |
| EP | 3228068 | | 10/2017 |
| IN | 032013 | | 1/2013 |
| JP | 09009339 | | 1/1997 |
| JP | 2004242129 | A | 8/2004 |
| JP | 2009092594 | A | 4/2009 |
| JP | 2010236866 | A | 10/2010 |
| JP | 605885 | B2 | 1/2017 |
| RU | 46597 | U1 | 7/2005 |
| RU | 2602700 | C2 | 11/2016 |
| SU | 1621067 | A1 | 1/1991 |
| WO | 2005001788 | A1 | 1/2005 |
| WO | 2011019525 | A2 | 2/2011 |
| WO | 2016089734 | A1 | 9/2016 |
| WO | 2016141582 | A1 | 9/2016 |
| WO | 2016182878 | A1 | 11/2016 |

OTHER PUBLICATIONS

Europe Patent Application No. 10193394.3, Summons to Attend Oral Hearings, mailed Dec. 8, 2016, 8 pages.

International Application No. PCT/US2015/031113, International Search Report, dated Jul. 11, 2016, 5 pages.

International Application No. PCT/US2015/031113, Written Opinion of the International Searching Authority, dated Jul. 11, 2016, 8 pages.

Europe Patent Application No. 10193394.3, Examination Report, dated Jun. 30, 2016, 6 pages.

Europe Patent Application No. 10193394.3, Examination Report, dated Apr. 21, 2011, 3 pages.

Europe Patent Application No. 10193394.3, Summons to Attend Oral Hearings, dated Dec. 8, 2016, 8 pages.

U.S. Appl. No. 14/730,794, Restriction Requirement, dated Jan. 23, 2017, 9 pages.

(56) References Cited

OTHER PUBLICATIONS

International Application No. PCT/US2015/062916, International Search Report, dated Feb. 29, 2016, 3 pages.
International Application No. PCT/US2015/062916, Written Opinion of the International Searching Authority, dated Feb. 29, 2016, 7 pages.
International Application No. PCT/CN2015/074089, International Search Report, dated Oct. 28, 2015, 3 pages.
International Application No. PCT/CN2015/074089, Written Opinion of the International Searching Authority, dated Oct. 28, 2015, 7 pages.
International Application No. PCT/US2016/031113, International Search Report, dated Jul. 11, 2016, 5 pages.
International Application No. PCT/US2016/031113, Written Opinion of the International Searching Authority, dated Jul. 11, 2016, 8 pages.
True Wirelss TM Gas Transmitters, 2008, Retrieved from the Internet: <www.gastronics.com>, 2 pages.
Neotronics Safe-T-Cube, 2005, Retrieved from the Internet on Apr. 5, 2017; Retrieved from the Internet: <http://www.abstrumenti.com/datasheet/safe-t-cube.pdf.>, 4 pages.
Safe-T-Cube, Retrieved from the Internet on: Sep. 19, 2009; Retrieved from the Internet: <http://nutech-australia.com.au/nutech-australia.com.au/Neotronics>, 1 page.
Europe Patent Application No. 10193394.3, Decision to Refuse, dated Jul. 20, 2017, 33 pages.
International Application No. PCT/CN2015/074089, International Preliminary Report on Patentability, dated Sep. 12, 2017, 5 pages.
U.S. Appl. No. 15/557,766, filed Sep. 12, 2017, 19 pages.
Europe Patent Application No. 10193394.3, Examination Report, dated May 3, 2017, 7 pages.
International Application No. PCT/US2015/062916, International Preliminary Report on Patentability, dated Jun. 6, 2017, 8 pages.
U.S. Appl. No. 15/532,620, filed Jun. 2, 2017, 19 pages.
U.S. Appl. No. 14/730,794, Office Action, dated Apr. 18, 2017, 18 pages.
U.S. Appl. No. 14/730,794, Final Office Action, dated Aug. 30, 2017, 12 pages.
Sierra Monitor Corporation, Sentry 8 Channel Gas Detection Controller Data Sheet, http://www.sierramonitor.com/assets/blt76714116742534fe/SMC%20Data%20Sheet%20-%20Sentry%20Controller.pdf, 2009, 4 pages.
Europe Patent Application No. 15816952.4, Communication Pursuant to Rules 161(1) and 162 EPC, dated Jul. 11, 2017, 2 pages.
Europe Patent Application No. 11191449, European Search Report, dated May 8, 2012, 4 pages.
Junjie Chen et al., "A Weighted Compensated Localization Algorithm of Nodes in Wireless Sensor Networks", Advanced Computational Intelligence, Aug. 25-28, 2010, Zushou, Juiangsu, China, pp. 379-384.
Elisabetta Farella et al., "Aware and smart environments: The Casanetta project", Microelectronics Journal 41 (2010), pp. 697-702.
U.S. Appl. No. 12/959,250, Office Action, dated Oct. 4, 2012, 40 pages.
U.S. Appl. No. 12/959,250, Notice of Allowance, dated Jan. 18, 2013, 12 pages.
Russia Patent Application No. 2011149131, Office Action, dated Sep. 23, 2015, 12 pages.
Russia Patent Application No. 2011149131, Office Action, dated Feb. 19, 2016, 14 pages.
Russia Patent Application No. 2011149131, Notice of Allowance, dated Jun. 14, 2016, 23 pages.
Japan Patent Application No. 2011-263814, Office Action, dated Aug. 4, 2015, 10 pages.
Japan Patent Application No. 2011-263814, Office Action, dated Apr. 12, 2016, 7 pages.
Japan Patent Application No. 2011-263814, Notice of Allowance, dated Nov. 9, 2016, 3 pages.
Europe Patent Application No. 11191449, Examination Report, dated May 21, 2012, 8 pages.
Europe Patent Application No. 11191449, Examination Report, dated May 5, 2015, 4 pages.
Europe Patent Application No. 11191449, Intention to Grant, dated Jun. 23, 2016, 19 pages.
Europe Patent Application No. 11191449, Decision to Grant, dated Sep. 29, 2016, 2 pages.
Canada Patent Application No. 2760872, Office Action, dated Apr. 5, 2017, 3 pages.
China Patent Application No. 201110462147.9, Office Action, dated Oct. 30, 2014, 9 pages.
China Patent Application No. 201110462147.9, Office Action, dated Jul. 30, 2015, 4 pages.
China Patent Application No. 201110462147.9, Notification to Grant Patent Right, dated Feb. 5, 2016, 2 pages.
United Arab Emirates Patent Application No. 1221/2011, Notice of Acceptance, dated May 4, 2017, 2 pages.
International Application No. PCT/US2016/031113, International Preliminary Report on Patentability, dated Nov. 14, 2017, 9 pages.

* cited by examiner

WIRELESS LOCATION-BASED SYSTEM AND METHOD FOR DETECTING HAZARDOUS AND NON-HAZARDOUS CONDITIONS

CROSS-REFERENCE TO PROVISIONAL PATENT APPLICATION

This application is related to and claims priority from U.S. Provisional Patent Application No. 61/290,262, filed Dec. 28, 2009, and entitled "Wireless Location-Based System and Method for Detecting Hazardous and Non-Hazardous Conditions," the contents of which are hereby incorporated herein by reference in their entirety.

TECHNICAL FIELD

Embodiments are generally related to sensing devices and techniques. Embodiments are also related to sensors for detecting hazardous and non-hazardous conditions. Embodiments are additionally related to wireless communication devices and techniques. Embodiments are further related to detection systems for detecting the location of hazardous and non-hazardous conditions.

BACKGROUND OF THE INVENTION

In some situations, it may be desirable to detect accumulations of potentially hazardous gases before a hazardous situation exists. An industrial plant, for example, may deploy a gas detection system to include gas sensors distributed throughout the plant. Such a system may also include one or more central stations, which receive signals from the gas sensors. If one of the gas detectors detects an excessive amount of hazardous gas, for example, then an alarm condition is triggered at the central station. Such gas detection systems may further alert an operator so that an action may be taken to preclude a potentially harmful result within the plant.

While such systems are effective in fixed locations, such as nearby industrial equipment in an industrial plant, these types of systems are not portable or adaptable to changing conditions. Additionally, such conventional gas detection systems typically do not provide quick centralized access to information regarding gas detection events, including the location of the event(s) and location-based gas detection historical information. Further, if the conventional system does provide centralized access, expensive wiring is required to connect the gas detectors to the central station.

In some prior art gas detection systems, a personal belt-worn device may be utilized for detecting gas concentrations within a particular location. Such gas detectors may provide information regarding the state of the gas concentration as a function time. A central station operator, however, does not have access to location information and the gas concentration information as a function of time is not available until a much later time, when the device's daily log may be transferred to a personal computer.

Based on the foregoing, it is believed that a need exists for an improved wireless location-based gas detection system and method. A need also exists for wirelessly detecting location information associated with a hazardous gas event along with time information, as described in greater detail herein.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is, therefore, one aspect of the disclosed embodiment to provide for an improved gas detection system and method.

It is another aspect of the disclosed embodiment to provide for an improved location-based gas detection (and/or measurement) system and method for wirelessly measuring location information associated with a hazardous gas event in association with time information.

It is a further aspect of the disclosed embodiment to configure a user interface for visualizing information reported from the gas detection system.

The aforementioned aspects and other objectives and advantages can now be achieved as described herein. A wireless location-based gas detection system and method includes a gas detector (also interchangeably referred to herein as a gas measurement device) for wirelessly detecting location information associated with a hazardous gas event. The system includes one or more portable gas detectors that monitor the gas events and wirelessly communicate information with respect to location of the event along with time information to a location manager module. The gas detector includes a wireless communication interface that may remain in association with one or more location anchor points (e.g. IEEE 802.11 access points). The gas detector may periodically, and also upon event conditions, transmit the location related information, the time information, and the gas concentration level information to the location manager module. A location engine module in coordination with the location manager module calculates an estimated location of the gas detector based on the information related to the location received from the gas detector and provides the data to the location manager module.

The location manager module records the gas concentration level, the estimated location, and the time information into a database. The location manager module configures a graphical user interface for visualizing the current and historical information reported from the gas detector. The concentration levels and location of the gas event may be quickly accessed by the operator via the location manager module. The gas detectors measure information related to the location utilizing the wireless communication interface. In one embodiment, the gas detector measures the received signal strength level for packets received from one or more location anchors. The gas detector may also include a GPS receiver to measure location based on a global satellite navigation system. In another embodiment, the location anchors may measure and report to the location manager received signal strength levels for packets received from the gas detector.

The user interface associated with the location manager module generates various views with respect to the information stored into the database upon request by a user. A map representing an alarm condition associated with the gas detectors and a color coding of the gas concentration level as a function of the location may be configured in the user interface. The gas concentration level and the location of the gas detectors may be displayed as a function of time. A heat map (color coded contour plot of gas concentration over an area) associated with the gas concentration at a particular time derived from the gas detector reports may be also configured in the user interface.

Optionally, a motion picture may be displayed as function of time of the gas heat map and a future gas concentration map can be predicted based on the stored data. The operator may effectively access the location manager module and acknowledge the information associated with the hazardous gas event. The operator can therefore effectively access the concentration levels of toxic gases and the location information reported from the gas detection devices. The operator may also review an historical log of time-based data for one or more gas detectors including the position as well as gas concentration level as a function of time.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

The particular values and configurations discussed in these non-limiting examples can be varied and are cited merely to illustrate at least one embodiment and are not intended to limit the scope thereof.

The disclosed embodiments may be employed to detect and wirelessly transmit data with respect to a hazardous gas event at remote locations in association with time information. The approach described herein is capable of generating an alarm when the concentration of a toxic gas becomes excessive, or when an abnormal change in the concentration of gases within a particular location is detected. The disclosed location-based gas detecting system provides an identification of the hazardous gas at the remote location, information about the gas concentration level, information about the time of the gas detection, and information about the location of the event. The approach described herein may also be capable of measuring levels of gas presence and periodically reporting the levels along with the time and location information.

Figure 1:
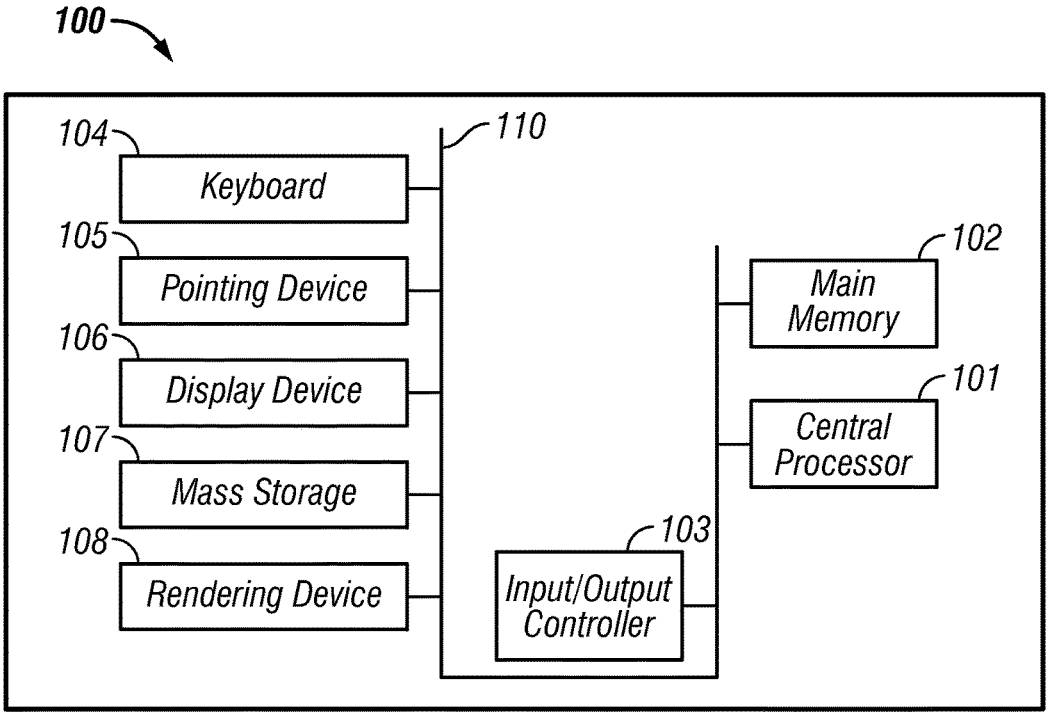
FIG. 1 illustrates a schematic view of a data-processing system in which one or more embodiments may be implemented.
Figure 2:
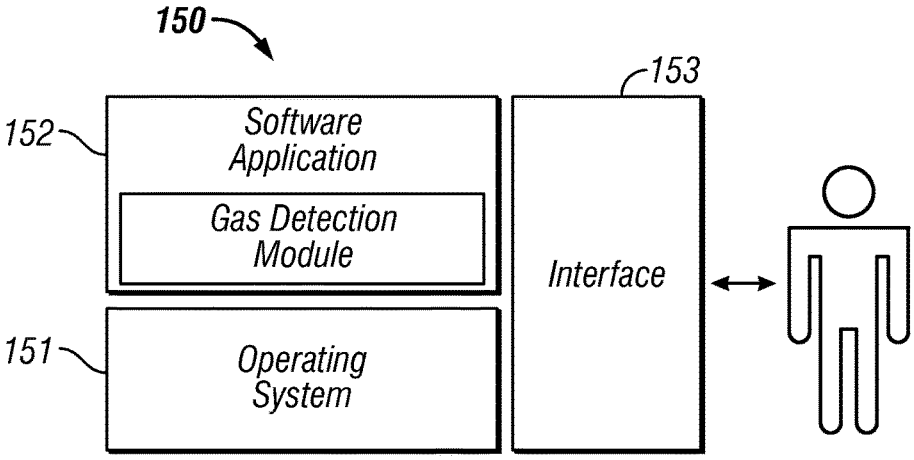
FIG. 2 illustrates a schematic view of a software system including an operating system, application software, and a user interface for carrying out an embodiment.
Figure 3:
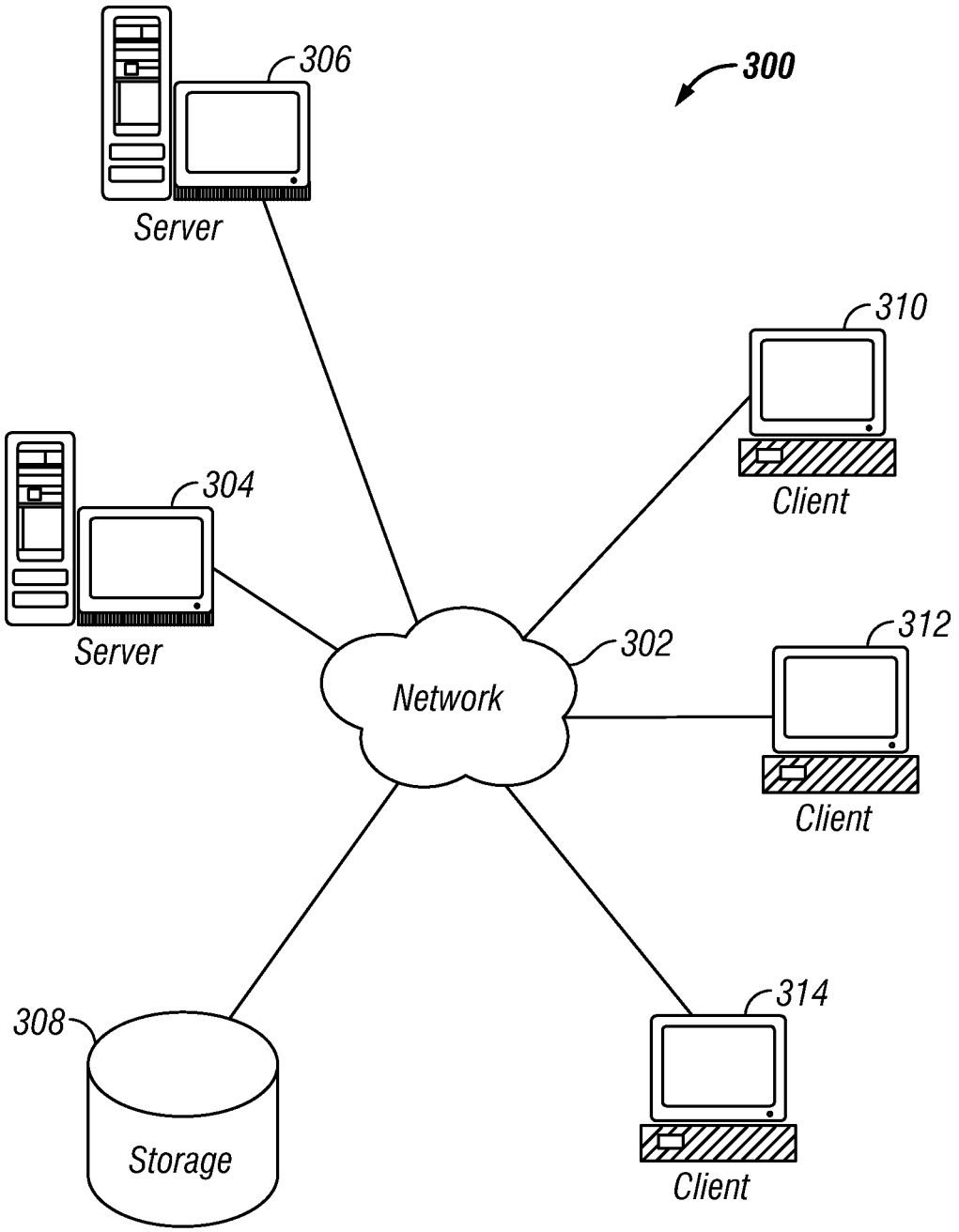
FIG. 3 illustrates a graphical representation of a network of data-processing systems in which aspects of the disclosed embodiments may be implemented.

Note that in FIGS. 1-15, identical or similar parts or elements are generally indicated by identical reference numerals. FIGS. 1-3 are provided as exemplary diagrams of data-processing environments in which embodiments of the present invention may be implemented. It should be appreciated that FIGS. 1-3 are only exemplary and are not intended to assert or imply any limitation with regard to the environments in which aspects or embodiments of the disclosed embodiments may be implemented. Many modifications to the depicted environments may be made without departing from the spirit and scope of the present invention.

As illustrated in FIG. 1, the disclosed embodiments may be implemented in the context of a data-processing system 100 comprising, for example, a central processor 101, a main memory 102, an input/output controller 103, a keyboard 104, a pointing device 105 (e.g., mouse, track ball, pen device, or the like), a display device 106, and a mass storage 107 (e.g., hard disk). Additional input/output devices, such as a rendering device 108 (e.g., printer, scanner, fax machine, etc), for example, may be associated with the data-processing system 100 as desired. As illustrated, the various components of data-processing system 100 communicate electronically through a system bus 110 or similar architecture. The system bus 110 may be a subsystem that transfers data between, for example, computer components within data-processing system 100 or to and from other data-processing devices, components, computers, etc.

FIG. 2 illustrates a computer software system 150 for directing the operation of the data-processing system 100 depicted in FIG. 1. Software application 152, stored in main memory 102 and on mass storage 107, generally includes a kernel or operating system 151 and a shell or interface 153. One or more application programs, such as software application 152, may be "loaded" (i.e., transferred from mass storage 107 into the main memory 102) for execution by the data-processing system 100. The data-processing system 100 receives user commands and data through user interface 153; these inputs may then be acted upon by the data-processing system 100 in accordance with instructions from operating system 151 and/or software application 152.

The following discussion is intended to provide a brief, general description of suitable computing environments in which the system and method may be implemented. Although not required, the disclosed embodiments will be described in the general context of computer-executable instructions, such as program modules, being executed by a single computer or multiple computers, depending upon design considerations.

Generally, program modules include, but are not limited to, routines, subroutines, software applications, programs, objects, components, data structures, etc., that perform particular tasks or implement particular abstract data types and instructions. Moreover, those skilled in the art will appreciate that the disclosed method and system may be practiced with other computer system configurations such as, for example, hand-held devices, multi-processor systems, data networks, microprocessor-based or programmable consumer electronics, networked PCs, minicomputers, mainframe computers, servers, and the like.

Note that the term module as utilized herein may refer to a collection of routines and data structures that perform a particular task or implements a particular abstract data type. Modules may be composed of two parts: an interface, which lists the constants, data types, variable, and routines that can be accessed by other modules or routines; and an implementation, which is typically private (accessible only to that module) and which includes source code that actually implements the routines in the module. The term module may also simply refer to an application such as a computer program designed to assist in the performance of a specific task such as word processing, accounting, inventory management, etc.

The interface 153, which is preferably a graphical user interface (GUI), can serve to display results, whereupon a user may supply additional inputs or terminate a particular session. In some embodiments, operating system 151 and interface 153 can be implemented in the context of a "Windows" system. It can be appreciated, of course, that other types of operating systems and interfaces may be alternatively utilized. For example, rather than a traditional "Windows" system, other operation systems such as, for example, Linux may also be employed with respect to operating system 151 and interface 153. The software application 152 can include a gas detection module for detecting presence of a hazardous gas event and information related to the location of the event. The gas detection module may wirelessly communicate the gas concentration information and the location information along with time information. Software application 152 module, on the other hand, can include instructions such as the various operations described herein with respect to the various components and modules described herein such as, for example, the method 600 depicted in FIG. 13. Method 600 can be, for example, implemented via multiple computers and multiple software applications (e.g., gas application and location manager application).

FIG. 3 illustrates a graphical representation of a network of data-processing systems in which aspects of the disclosed embodiments may be implemented. Network data-processing system 300 is a network of computers in which embodiments of the present invention may be implemented. Network data-processing system 300 contains network 302, which is the medium used to provide communication links between various devices and computers connected together within network data-processing system 300. Network 302 may include connections such as wire, wireless communication links, or fiber optic cables.

In the depicted example, server 304 and server 306 connect to network 302 along with storage unit 308. In addition, clients 310, 312, and 314 connect to network 302. These clients 310, 312, and 314 may be, for example, gas detectors, personal computers or network computers. Data-processing system 100 depicted in FIG. 1 can be, for example, a client such as client 310, 312, and/or 314. Alternatively, data-processing system 100 can be implemented as a server such as servers 304 and/or 306, depending upon design considerations.

In the depicted example, server 304 provides data such as boot files, operating system images, and applications to clients 310, 312, and 314. Clients 310, 312, and 314 are clients to server 304 in this example. Network data-processing system 300 may include additional servers, clients, and other devices not shown. Specifically, clients may connect to any member of a network of servers which provide equivalent content.

In the depicted example, network data-processing system 300 may be the Internet with network 302 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, government, educational, and other computer systems that route data and messages. Of course, network data-processing system 300 may also be implemented as a number of different types of networks such as, for example, an intranet, a local area network (LAN), or a wide area network (WAN). FIG. 3 is intended as an example and not as an architectural limitation for varying embodiments of the present invention.

The description herein is presented with respect to particular embodiments of the present invention, which may be embodied in the context of a data-processing system such as, for example, data-processing system 100 and computer software system 150 illustrated with respect to FIGS. 1-2. Such embodiments, however, are not limited to any particular application or any particular computing or data-processing environment. Instead, those skilled in the art will appreciate that the disclosed system and method may be advantageously applied to a variety of system and application software. Moreover, the present invention may be embodied on a variety of different computing platforms, including Macintosh, UNIX, LINUX, and the like.

Figure 4:
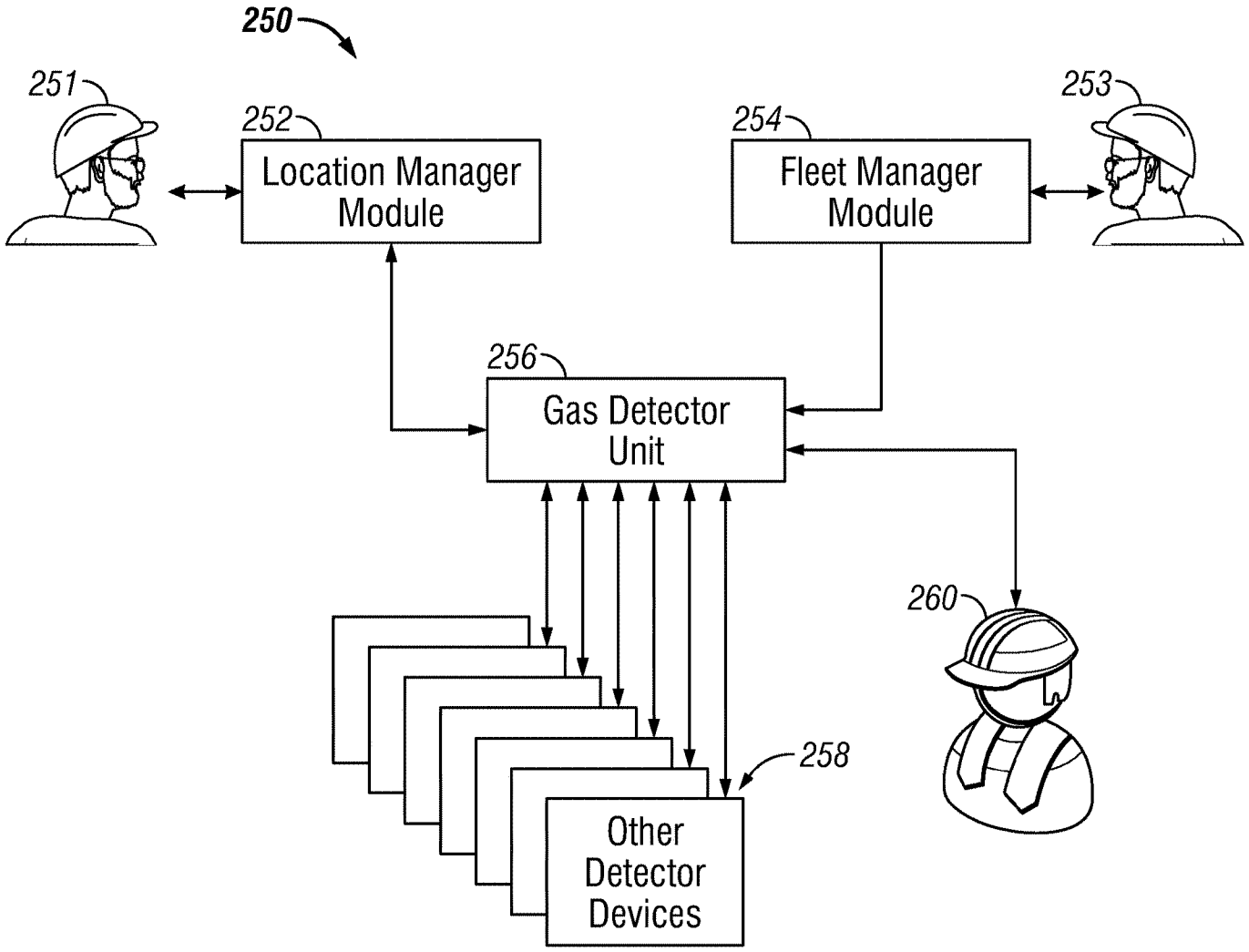
FIG. 4 illustrates a block diagram of a location-based gas detection system, in accordance with the disclosed embodiments.

FIG. 4 illustrates a block diagram of a gas detection system 250, in accordance with the disclosed embodiments. The gas detection system 250 generally includes a fleet manager module 254 and a location manager module 252 that can communicate with a gas detector unit 256. The gas detection system 250 detects the presence of a hazardous gas event within a particular location (e.g., within a specific area of an industrial plant) and alerts a local gas detector operator 260 as well as the location manager operator 251. Note that the operator 260 can operate the disclosed gas detector unit 256. The operator 260 is different (typically) from the location manager operator 251 and the fleet manager operator 253 disclosed in FIG. 4. The operator 260 may be, for example, an individual out in the plant or other facility wearing the disclosed gas detector on his or her belt.

Figure 8:
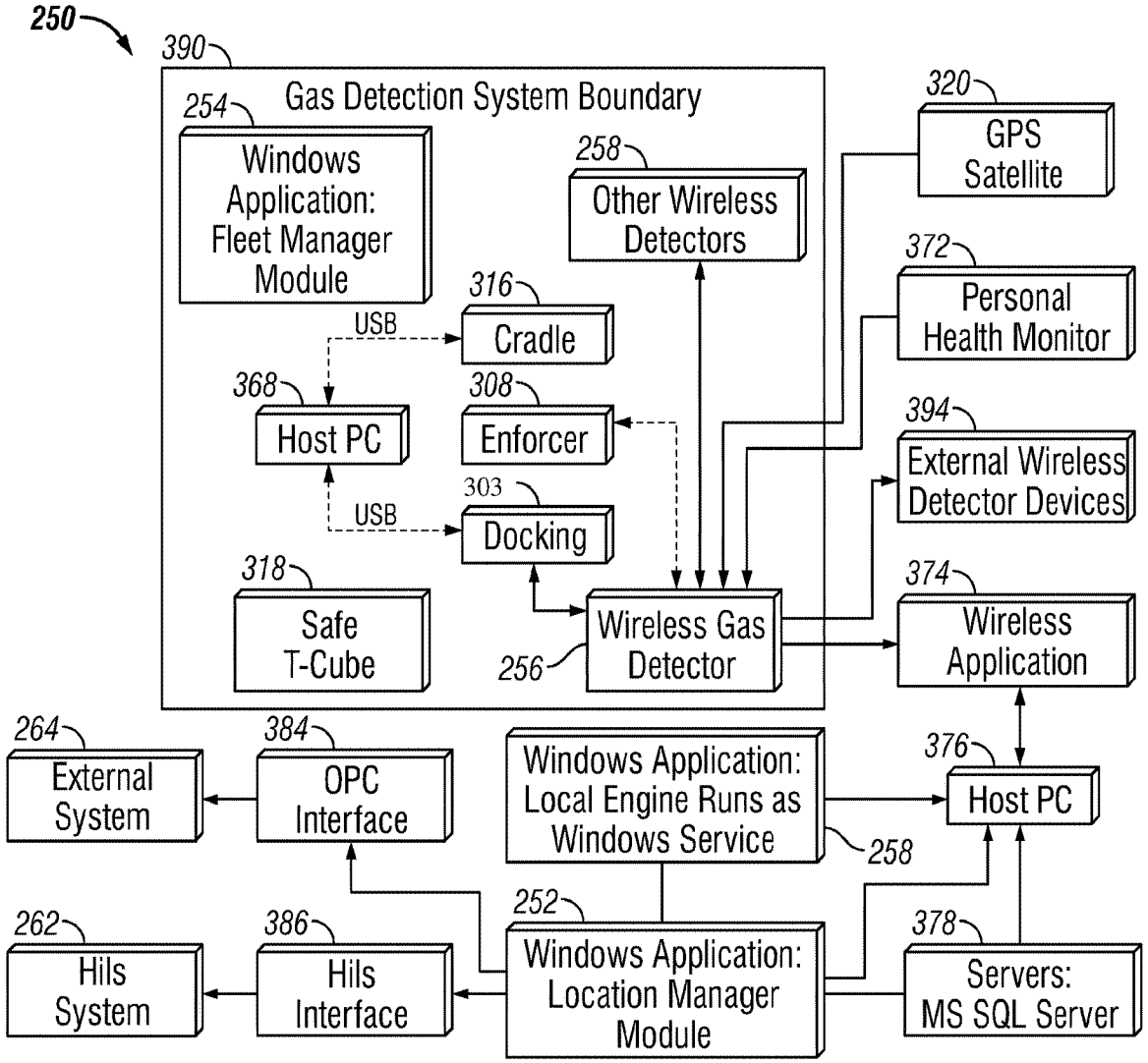
FIG. 8 illustrates a block diagram of a wireless communication environment associated with the gas detection system, in accordance with the disclosed embodiments.

The gas detection system 250 can be configured to provide information regarding the time and location of a gas detection event and can communicate such data to the operator 251 or to other systems via a data export OPC interface 384 illustrated and discussed herein with respect to FIG. 8. The gas detection system 250 generally includes a gas detector unit 256 that can communicate with one or more other detector devices 258 situated at various locations in the facility which provides signals representing a number of gas concentration measurements to the one or more location manager modules 252. The gas detection system 250 can be further configured to include one or more fleet manager modules 254. An operator 253 can communicate via a user interface with the fleet manager module 254 (which also can be referred to simply as a "fleet manager"). The fleet manager module 254 may include, for example, software that provides configuration data to the gas detector unit 256 as well as software for data logging and reporting associated with an asset management database.

The gas detector unit 256 may be configured as a multi-gas portable device that is capable of measuring more than one type of gas. The gas detector unit 256 may be configurable to include several of a broad range of available detectors, a data gathering and communication device, and other end user features such as an annunciator that alerts the operator to the presence of a hazardous condition and thereby improves the operator safety. Such gas detectors may include, for example, radiation detectors, smoke detectors, and detectors for determining abnormally low oxygen content in the atmosphere, as well as a wide variety of detectors for detecting chemically hazardous or flammable gases such as, for example, hydrogen sulfide, ammonia, carbon monoxide, natural gas, phosgene, and so forth. The gas detector unit 256 can also be configured to include integrated wireless communications and the ability to periodically and under event conditions, report the location information, time information, and gas concentration level information wirelessly.

The location manager module 252 can be implemented as a software application module that provides location data concerning the detected hazardous gas event and then interacts with the location manager operator 251. In some embodiments, a server itself may function as a location manager by processing instructions provided by the location manager module 252. The location manager module 252 may be loaded to, for example, server 304 and/or server 306 depicted in FIG. 3. The location manager module 252 records information obtained from the gas detector unit 256. The location manager module 252 may be employed for collecting, logging, and presenting gas detection information received from the gas detector unit 256 to the operator 251.

The location manager module 252 can also be employed to automatically configure a graphical display (e.g., a GUI) to display data indicative of current and historical information reported from gas detector unit 256 and/or other detector devices 258, so that appropriate action may be taken to preclude a potentially harmful result from occurring. For example, gas concentration levels and location information regarding the detected gas can be accessed quickly by the operator 251 via the location manager module 252. The disclosed embodiments enable the operator 251, for example, who may be located in some situations in a control room, to become aware of a potential hazardous condition, while offering centralized monitoring and time-stamped record keeping and, for example, gas cloud monitoring of motion, etc. Note that the preclusion of harm can also be accomplished by the detector itself in its sounding of alarm to be observed by operator 260.

The fleet manager module 254 can include data logging and reporting software associated with an asset management database. Note that the location manager module 252 and the fleet manager module 254 as utilized herein refer generally to computer programs or other modules that interact with a host application to provide a certain, usually very specific, function "on demand".

The gas detection system 250 may be operated in various modes such as for example, in "infrastructure" mode, or an "incident/response" mode. The gas/location/alarm data may be transmitted to the location manager module 252 in the infrastructure mode using, for example, a network 302 infrastructure. Alternatively, the gas/alarm data may be shared among the gas detector units 256 depicted in FIG. 5 and with the location manager module 252 in the incident/response mode. In incident/response mode, the gas detectors may form a mesh connected set which may cover a large incident area to store and forward the gas/alarm data among the detectors and to the location manager.

Note that the gas detection system 250 may be suitable for rapid deployment in remote areas where access to a wireless infrastructure is restricted. The gas monitoring system 250 inclusive of GPS receivers and Wi-Fi communications integrated into the gas detectors may provide a mesh connected set of location aware gas detectors covering a large incident area. In addition, coupling the location manager to a satellite radio or other cellular device may make the location monitoring data quickly and easily available at distant locations. The gas detection system 250 effectively provides location based early warnings, detailed information respecting the nature and direction of the toxic gas location, and historical gas information records. The disclosed embodiment can therefore efficiently and affordably process and transmit the gas sensor data without compromising the quality or completeness of the required gas detection information.

Figure 5:
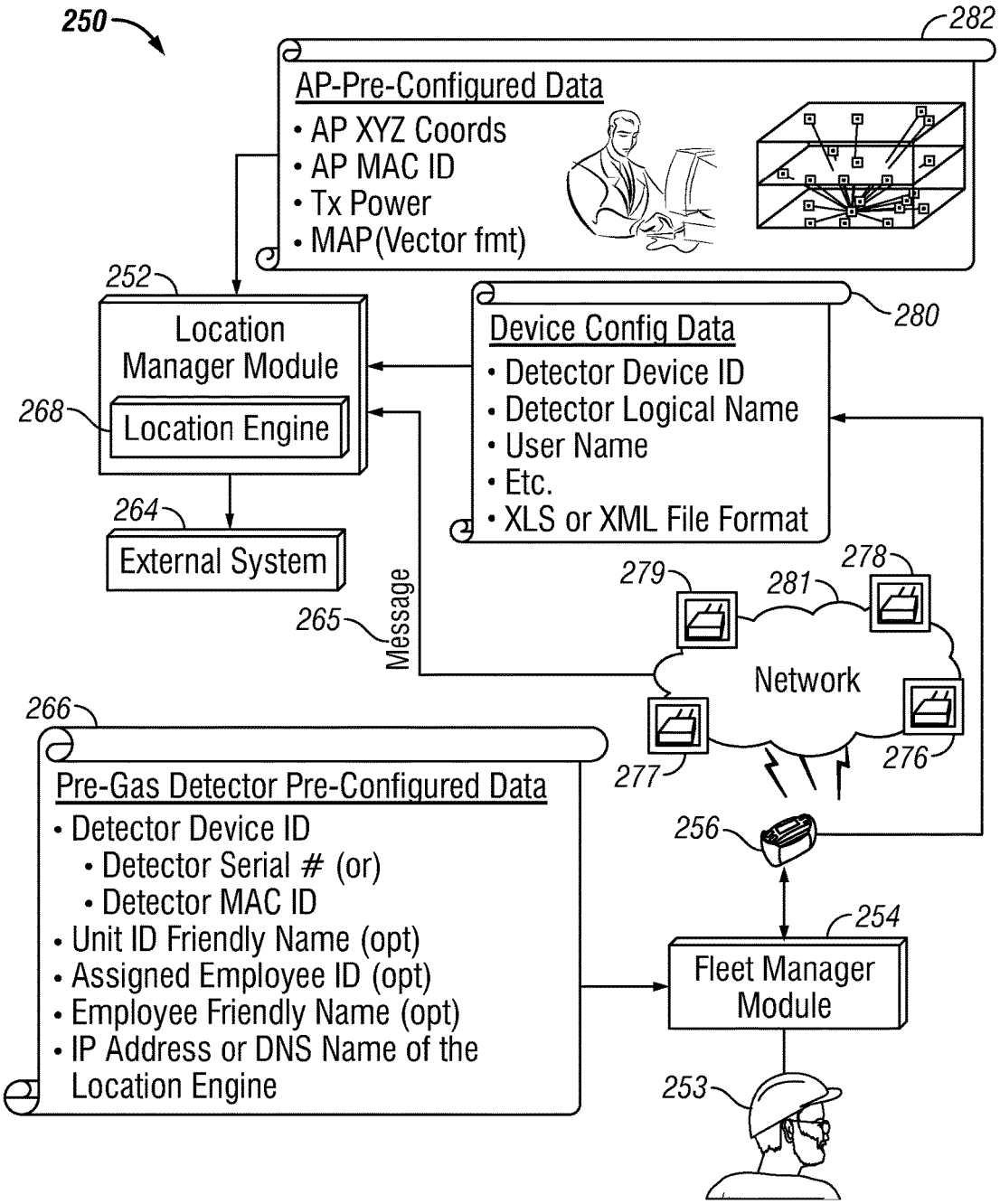
FIG. 5 illustrates a data flow diagram associated with the gas detection system, in accordance with the disclosed embodiments.

FIG. 5 illustrates a data flow diagram depicting logical operations of a gas detection system 250, in accordance with the disclosed embodiments. The gas detection system 250 depicted in FIG. 5 generally comprises a network 281 that includes one or more wireless location anchor points such as, for example, location anchor points 276, 277, 278, 279 for the provision of a wireless location service. Note that the location anchor points 276, 277, 278, 279 may each optionally provide a Wi-Fi infrastructure service, for example, by providing an IEEE 802.11 access point service. Alternatively, a location anchor may solely provide location service and not Wi-Fi access point service.

When acting as an access point, the location anchor may provide service as a component of the network 281 to relay information, for example, message 265 from the gas detector unit 256 to one or more location manager modules such as, for example, location manager module 252. The access points utilized for the wireless communications are devices that include location anchor point functions however, location anchors may optionally include access point service. The network 281 can communicate with the location manager module 252 and hence the location engine 268. A message 265 which includes gas measurement and location related information can be sent from gas detector unit 256 via the network 281 to the location manager module 252.

The gas detector(s) unit(s) 256 may provide multi-hop peer-to-peer device communication for detecting and transmitting the gas detection and location information to the location engine 268 that communicates with the location manager module 252. The location anchor points 276, 277, 278 and/or 279 may be employed to monitor the gas detector(s) unit(s) 256 and transfer the monitored information to the location engine 268, To configure the gas detectors, such as gas detector unit 256, the fleet manager module 254 may be loaded to be operable on a server such as, for example, servers 304 and/or 306, The fleet manager module 254 can receive detector pre-configuration data 266 such as, for example, detector device ID, detector MAC ID, an assigned employee ID, and IP address or the DNS name of the location engine 268 from an operator 253 of the fleet manager module 254. The fleet manager module 254 may then configure the gas detector unit 256 with that pre-configuration data.

The information related to the location including the received signal strength level from the signals received from the location anchor points 276, 277, 278 and/or 279 can be measured by the gas detector unit 256 and/or other detectors such as device(s) 258. Subsequently, the information related to the location and the gas detection information may be sent to the location manager module 252 via any location anchor that includes an access point function. That is, it can be appreciated that each of the location anchor points 276, 277, 278 and/or 279 can be configured with an access point functionality, depending upon design considerations. In some embodiments, the location anchor point(s) 276, 277, 278 and/or 279 may also be capable of measuring time of flight data and/or perform the function of an RFID reader to obtain data indicative of the presence of an RFID tag. In such an embodiment, the RFID tag may be located on the gas detector unit 256. Note that in other embodiments, the location anchor point(s) 276, 277, 278 and/or 279 may measure the signal strength level from signals received from the gas detector unit 256 and report the signal strength levels to the location engine 268.

As indicated in FIG. 5, the location engine 268 is preferably placed within the location manager module 252, although this is not a requirement of the disclosed embodiments. The location manager module 252 and the location engine 268 may be configured prior to performing location estimates and can be configured to receive information associated with the location and the MAC IDs of the location anchor points 276, 277, 278 and/or 279 via application pre-configuration data 282. The pre-configuration data 282 may include, for example, x, y, z or latitude, longitude, and altitude coordinates of the location anchors/access points. The data 282 may also include the RF transmit power of the location anchors/access points. The data 282 may further include one or more maps or images of the site for use in the location manager for graphical display of location information.

The gas detector unit 256 may further provide a device configuration data 280 to the location manager module 252 before an initial start up and/or configuration change in the gas detector unit 256. The device configuration data 280 may include information with respect to the gas detector unit 256 such as a detector device ID, a gas detector logical name, etc. Once configured with the data 282 and data 280, the location engine 268 can calculate an estimated location of a gas detector unit 256 based on the information related to the location received from the gas detector unit 256.

The gas detector unit 256 can measure a received wireless signal strength level for signals received from one or more anchor points 276, 277, 278 and/or 279 and report values along with the associated location anchor identification information to the location manager module 252. The location engine 268 having information regarding the location of the location anchor points 276, 277, 278 and/or 279, can estimate the location of gas detector units 256 based on the reported signal strength levels and the identifications associated with the location anchor points 276, 277, 278 and/or 279. The location manager module 252 may then store the gas concentration, location estimates, and time information into a database such as the database 378 illustrated and discussed herein with respect to FIG. 8. The location manager module 252 may further provide such information to an external system 264. Therefore, the operator 251 may effectively access the location manager module 252 and become aware of the location information associated with the hazardous gas event along with the time information.

Figure 6:
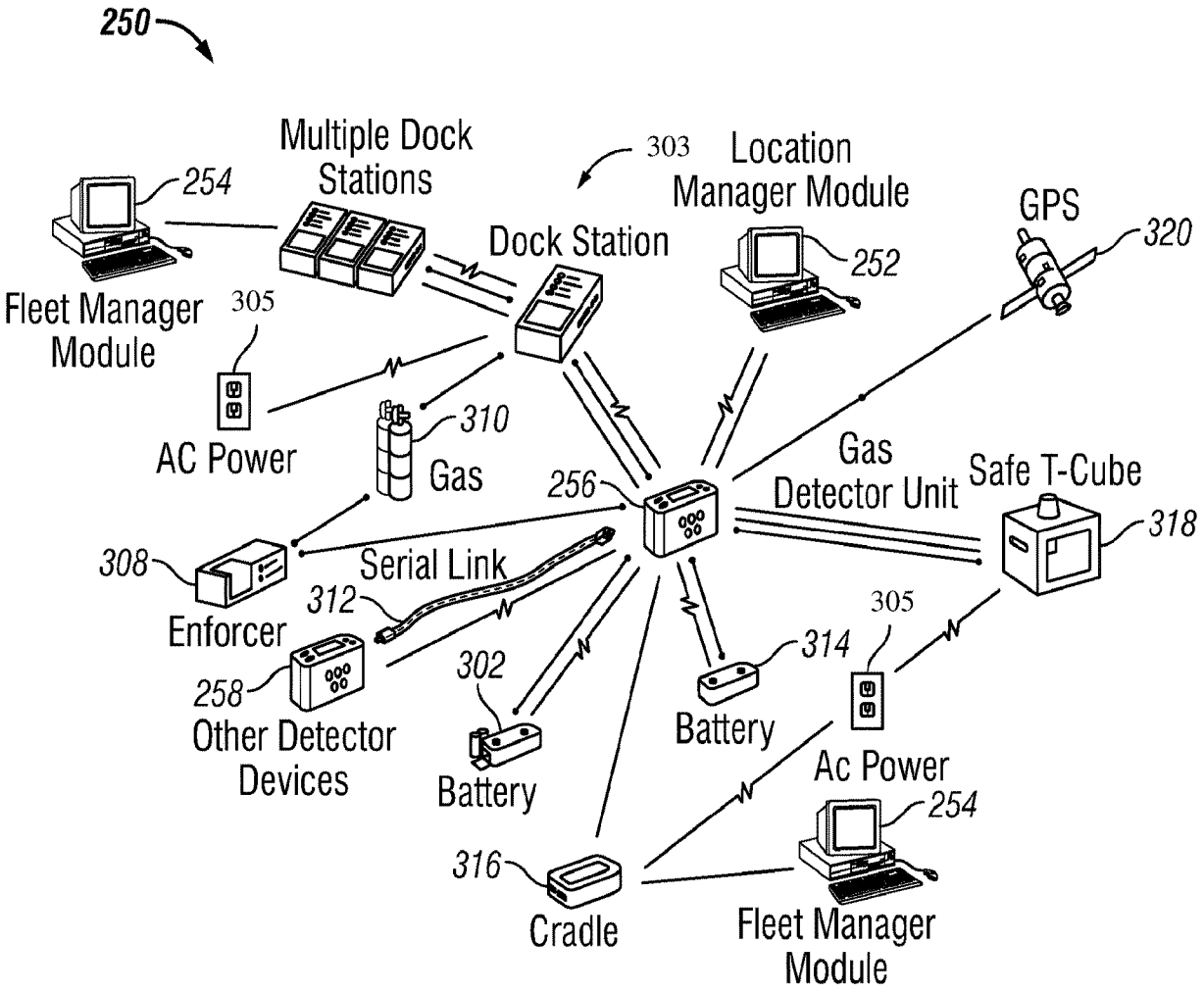
FIG. 6 illustrates a functional block diagram illustrating major components of the gas detection system, in accordance with the disclosed embodiments.

FIG. 6 illustrates a physical block diagram illustrating major physical components of the gas detection system 250, in accordance with the disclosed embodiments. The gas detector unit 256 monitors the concentration of the toxic gas within the particular location and records the information related to the location and historical gas detection information associated with hazardous gas concentration levels. The gas detector unit 256 may wirelessly communicate the monitored data to the location manager module 252 via the location anchor points 276, 277, 278 and/or 279 (not shown in FIG. 6, but depicted in FIG. 5). The gas detector unit 256 may be connected to the fleet manager module 254 via one or more dock stations 303. The dock stations 303 may provide a simplified way of "plugging-in" the gas detector as a common computer peripheral to the fleet manager. The dock station 303 may also provide various communication functions such as bump, cal, data, and charge between the fleet manager module 254 and the gas detector unit 256. Such dock stations 303 may be connected to an AC power supply 305.

An optional wireless location anchor device 320 may be employed for providing location service for the gas detector unit 256. Note that the wireless location anchor device 320 described herein can be a GPS (Global Positioning System) satellite as part of a global navigation satellite system. The use of the GPS satellite as a location anchor requires a GPS receiver module to be integrated into the gas detector unit 256.

The gas detector unit 256 may provide the measured gas detection level in analog format which is indicative of the concentration level of the toxic gas within the environment. The gas detector unit 256 may be provided power via a rechargeable battery 314 and/or a disposable battery 302, depending upon design considerations and goals. The gas detector unit 256 may be connected to other detector devices 258 via a serial link cable 312. A cradle 316 may be employed to charge and download the data between the fleet manager module 254 and the gas detector unit 256. The gas detection system 250 further includes an enforcer 308 that acts as an in-situ calibration device and provides physical connection between the gas detector unit 256 and a gas cylinder 310. A Safe T-cube 318 associated with the gas detection system 250 provides perimeter monitoring and environmental protection by generating stronger alarm signals. The Safe T-cube 318 and the cradle 316 may be powered via an international AC power supply 305.

In order to prevent a loss of battery power and provide energy savings, the gas detector unit 256 may not gather information related to the location of the device when the gas detector detects a lack of motion (e.g. utilizing an accelerometer sensor).

Time stamp information can also be sent by the gas detector along with other information. The gas detector unit 256 may have a sense of time derived from initial configuration by the fleet manager. Alternatively, the gas detector may have an independent time sense as periodically provided to it by the location manager module 252.

A text message may be sent by the operator 251 between the location manager module 252 and the gas detector unit 256 and the text message may be presented to and acknowledged by the operator 260. A text message may also be sent by the operator 260 via the gas detector unit 256 to the location manager module 252 to be presented to and acknowledged by the operator 251.

The gas detector unit 256 periodically reports gas detection status information and information related to location to the location manager module 252 and receives an acknowledgement from the location manager module for a subset of the reports. Note that these acknowledgments are different from text message acknowledgments that are generally for use by the disclosed operators such as, for example, operators 260 and 251 discussed earlier. Reports from the gas detector unit 256 are normally acknowledged by the location manager module 252. These acknowledgements are utilized to verify receipt of the information by the location manager. A subset of reports may be acknowledged because communications with the location manager may not be reliable or may not be continuously available in a wireless environment depending on the position and movement of the gas detector. The gas detector may retain the information sent to the location manager in a local log in the event that receipt of the information is not acknowledged by the location manager. The gas detector may also continue to periodically send new information to the location manager. Once an acknowledgement is received, the gas detector may send the entire log to the location manager.

Figure 7:
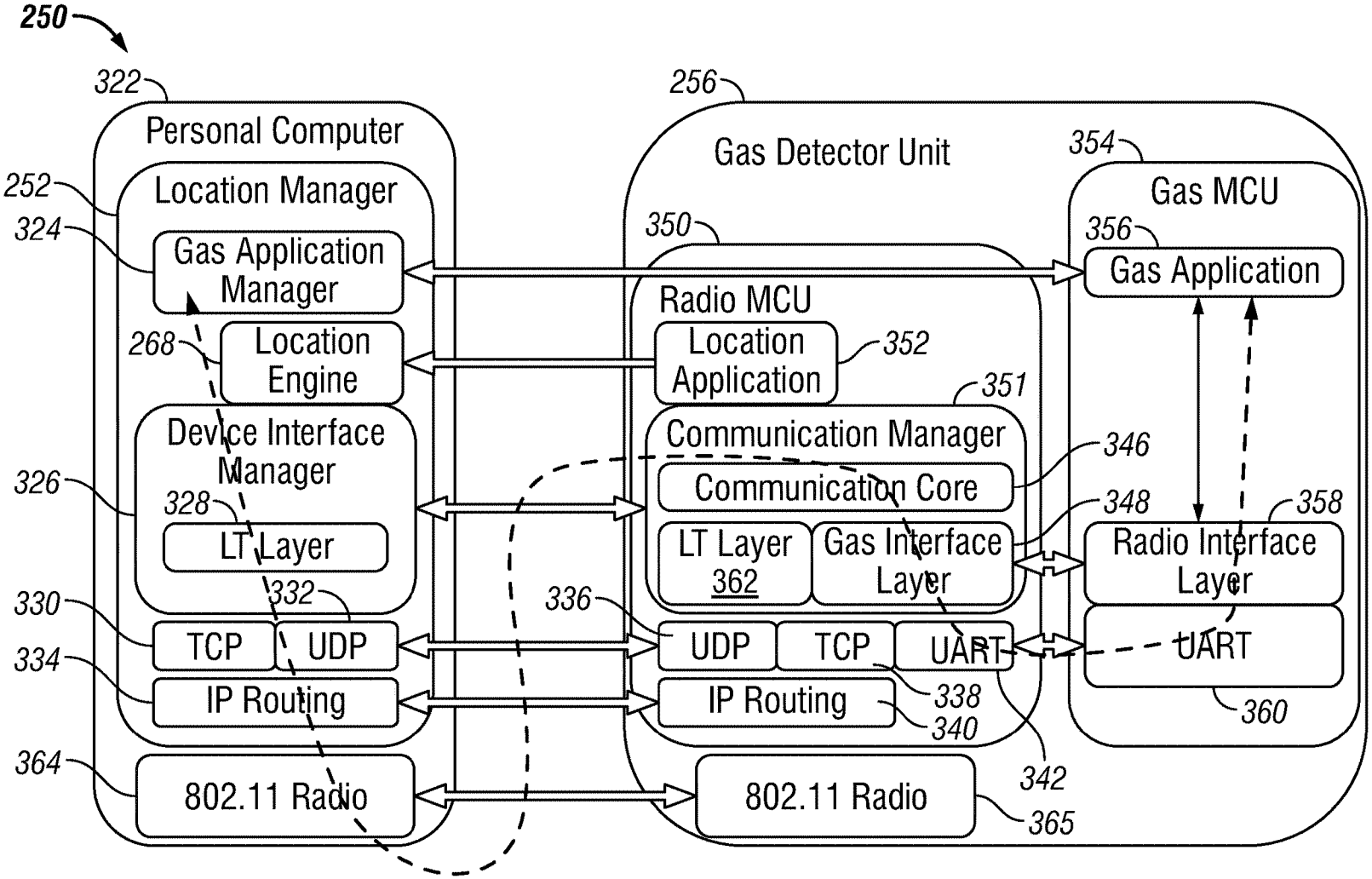
FIG. 7 illustrates a protocol layered architectural view of the gas detection system, in accordance with the disclosed embodiments.

FIG. 7 illustrates a possible protocol layered architectural view of the disclosed gas detection system 250. The gas detector unit 256 can be configured to include a gas MCU (Microprocessor Control Unit) 354 and a radio MCU 350. The gas MCU 354 generally includes a gas detection application 356, a radio interface layer 358, and a gas MCU UART (Universal Asynchronous Receiver/Transmitter) 360. The gas detector 256 also includes an IEEE 802.11 radio 365 capable of communicating with other IEEE 802.11 radios (e.g. the radio 364 in a personal computer 322 supporting the location manager module 252). The radio MCU 350 associated with the gas detector unit 256 can be responsible for managing the IEEE 802.11 radio 365, along with, in some embodiments, performing bootstrap, power management, and security, etc. The radio MCU 350 generally includes a location application 352, a communications manager 351, a UDP (User Datagram Protocol) 336, a TCP (Transmission Control Protocol) 338, a radio MCU UART (Universal Asynchronous Receiver/Transmitter) 342, and an IP (Internet protocol) routing 340. The communication manager 351 associated with the radio MCU 350 may be responsible for executive management of the radio MCU 350 functions and complexities.

The communication manager 351 is also responsible for UDP/TCP external communications and for boot strapping other radio MCU subsystems. The communication manager 351 includes a communication core 346, a radio MCU logging transport layer 362, and a gas interface layer 348 that communicates with the radio interface layer 358 of the gas MCU 354. The communication manager 351 aggregates location data from the location application 352 and delivers to the location engine 268 within the location manager module 252. The location application 352 of the gas detector unit 256 may be responsible for both periodic 802.11 RSSI scan function and for periodic GPS location acquisition/GPS receiver management. The gas detector unit 256 may communicate with the location manager module 252, which can be installed on, for example, a data processing apparatus such as personal computer 322 in order to transfer the monitored gas application information to a gas application manager 324. Note that the computer 322 can be, for example, a server, a computer workstation, a PDA (Personal Digital Assistant), Smartphone, etc.

The gas detector unit 256 and the location manager module 252 can communicate via the IEEE 802.11 radios 365 and 364. The location manager module 252 may include the location engine 268, a device interface manager 326 associated with a location manager logging transport layer 328, a location manager TCP 330, a location manager UDP 332, and a location manager IP routing 334. The location-based gas detection system 250 may be using, for example, the GUI on a personal computer to provide a simple interface for different skill levels. Also, the location-based gas detection system 250 may be calibrated for the quick/easy replacement of gas detector unit 256 and/or other detector devices 258, which can equipped in some embodiments with rechargeable and disposable batteries such as, for example, batteries 314 and 302.

FIG. 8 illustrates a block diagram of a wireless communication environment associated with the gas detection system 250, in accordance with the disclosed embodiments. The gas detection system 250 detects a wide variety of gases with greater accuracy and "safe" monitoring. The gas detection system 250 can be utilized for data administration, defensible data gathering, data reviewing, and event and data-logging. As indicated previously, the gas detector unit 256 may communicate with various other detector devices 258 located within a gas detector system boundary 390 via the serial link cable 312. The fleet manager module 254 may be loaded into a host personal computer 368 to access and modify the specifications of the gas detector unit 256 via the dock station 303 and the cradle 316.

The gas detector unit 256 receives GPS signals from the GPS satellite 320 that include location information. Also, a personal health monitor 372 that communicates with the gas detector unit 256 via a Bluetooth radio link provides status information, for example, heart rate of the operator 260. The gas detector unit 256 may communicate with various external wireless detector devices 394 via a wireless mesh. Further, the gas detector unit 256 may monitor various concentrations of the toxic gas and provide a wireless application 374 to a host personal computer 376 via a TCP/IP/UDP connection. The location manager module 252 may be loaded into the host personal computer 376 associated with a MS-SQL server 378. Note that the host personal computers 376 and 368 are similar and analogous to the host servers 304 and 306 in FIG. 3 and the data-processing system 100 depicted in FIG. 1. The location manager module 252 can further communicate the information to other external system 264 and the HILS system 262 via an OPC interface 384 and a HILS interface 386, respectively.

Figure 9:
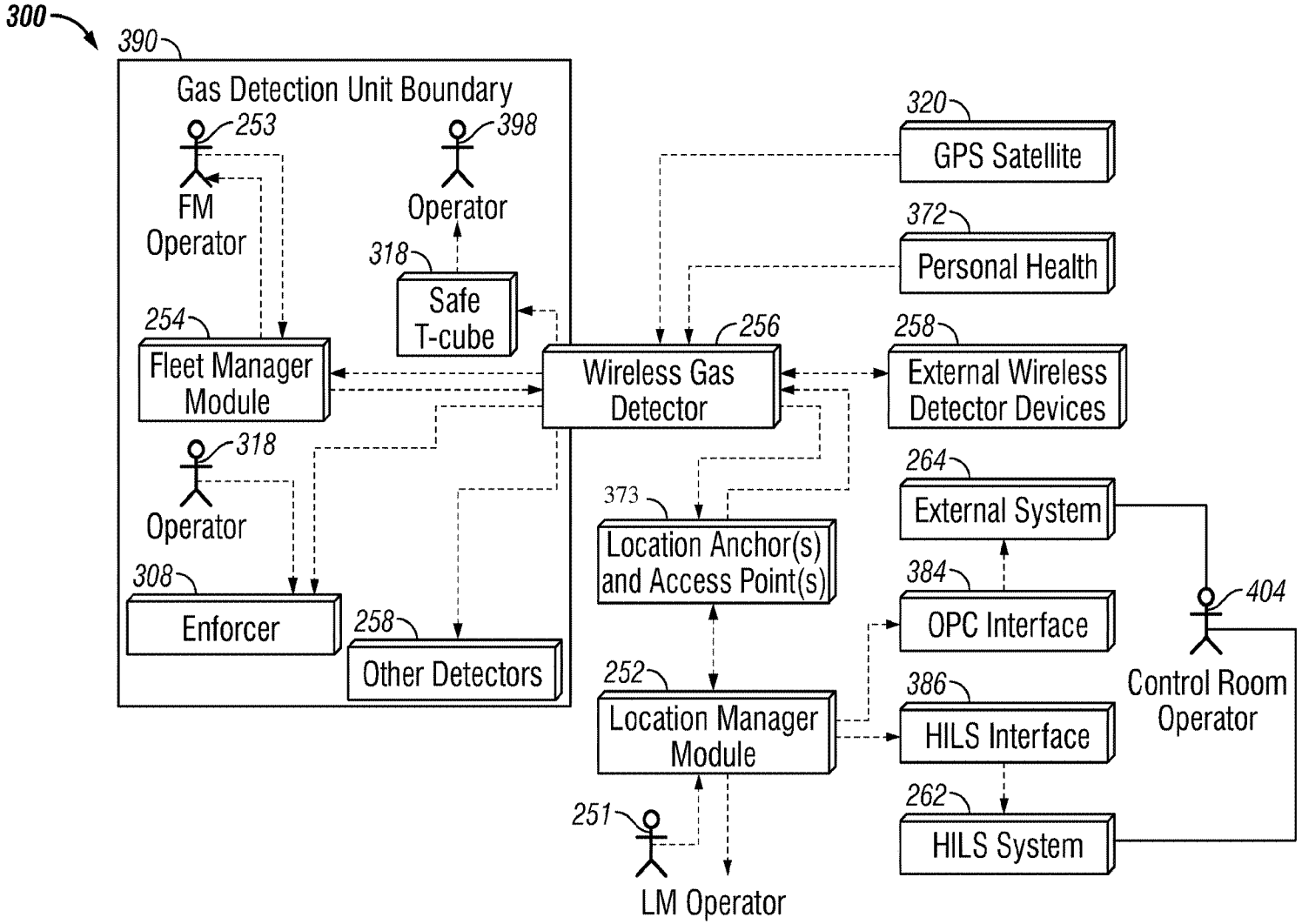
FIG. 9 illustrates an information flow diagram associated with the gas detection system, in accordance with the disclosed embodiments.

FIG. 9 illustrates an information flow diagram associated with the gas detection system 250, in accordance with the disclosed embodiments. The gas detector unit 256 can communicate with the fleet manager module 254 and can also receive configuration data from and provide logging data to the fleet manager module 254 being controlled by operator 253. The fleet manager operator 253 may respond to the information provided by the fleet manager module 254 and generate a configuration data software update to the gas detector unit 256. Further, an operator such as, for example, operator 398 can provide enforcer calibrations to the enforcer 308 where the enforcer 308 receives power and control line from the gas detector unit 256. The gas detector unit 256 may communicate with other detector devices 258 via the serial link cable 312 within the gas detector system boundary 390. The gas detector unit 256 may also communicate with one or more external gas detector units 258 via the mesh mode. Such communications can facilitate sharing of configuration data, events, and gas data among the detector unit(s) 256 and 258.

The gas detector 256 unit can respectively obtain GPS data and personal health information from a GPS satellite 320 and a personal health monitor 372, to be utilized when generating an event report. If an event is monitored, the gas detector unit 256 alerts the Safe T-cube 318 which further provides an alarm/fault signal to the operator 398. Further, the gas detector unit 256 may communicate via the wireless location anchor/access point 373 to the location manager module 252. The location manager operator 251 further retrieves the event information from the location manager module 252 and responds to the event. The location manager module 252 may also communicate the event data to an external system 264 and the HILS system 262 via the OPC interface 384 and the HILS interface 386, respectively. The OPC interface 384 is an open and standardized communication interface that provides direct interoperability between the external system 264 and the location manager module 252. A control room operator 404 may further retrieve the information from the HILS system 262 and external system 264 and further respond to the incident.

The location manager module 252 permits the operator 251 to view data concerning the site status and search information concerning gas detector unit 256, with the additional feature of navigating information concerning locations within the plant or facility. The operator 251 may also view entity status such as priority area information. The location manager module 252 may further permit the operator 251 to the view alarm status of the gas detector unit 256 within the particular location.

Figure 10:
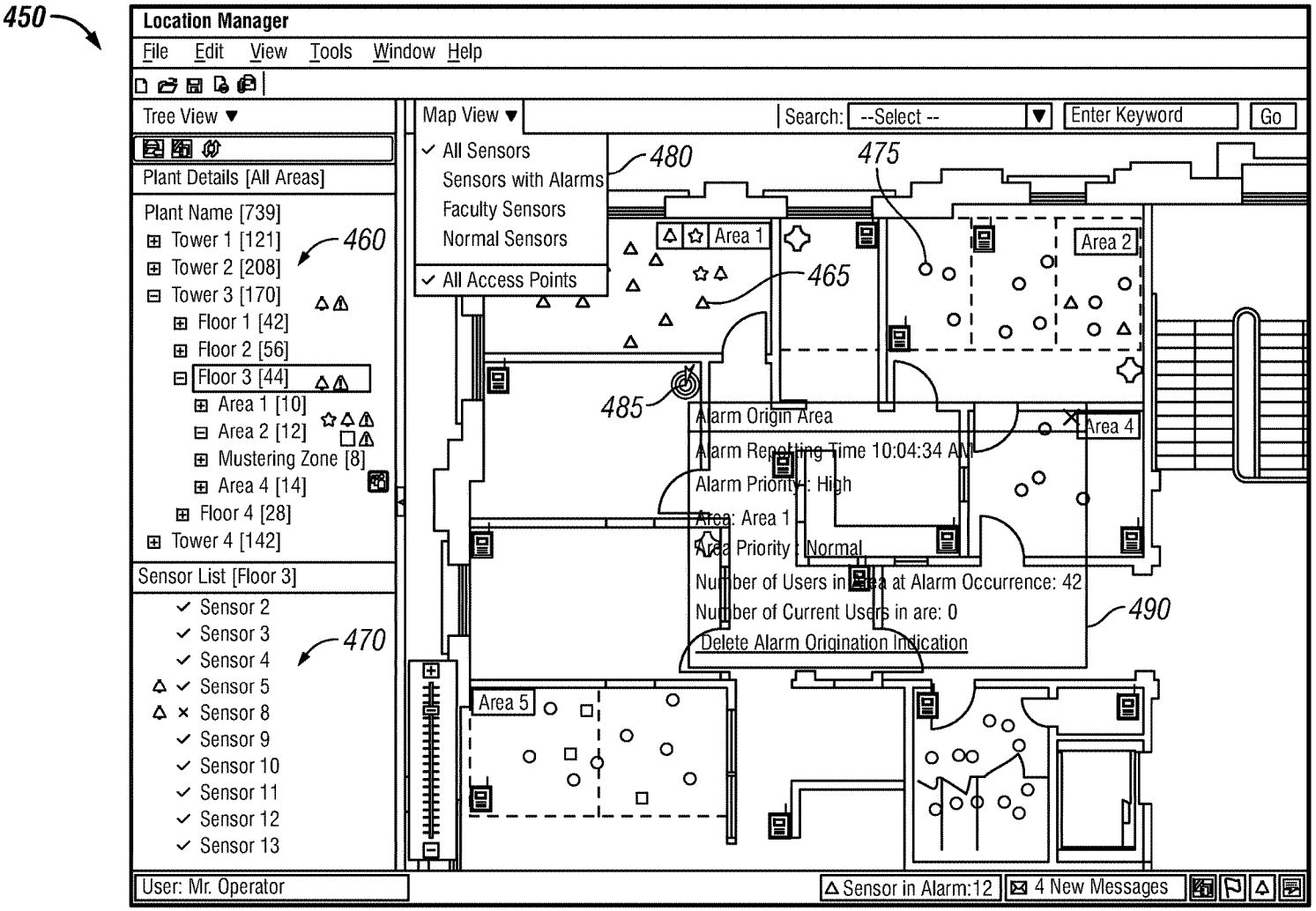
FIG. 10 illustrates a GUI of the location manager illustrating an alarm origin area, in accordance with the disclosed embodiments.

FIG. 10 illustrates a GUI 450 associated with the location manager module 252 illustrating an alarm origin area 490, in accordance with the disclosed embodiments. Note that the GUI 450, 500, and/or 550 may be implemented utilizing a GUI such as, for example, the GUI 153 depicted in FIG. 2 herein, and may be provided by a module such as, for example, module 152 (i.e., a software application). GUI 450, 500, and/or 550 can be displayed via a display device such as display device 106 depicted in FIG. 1. In the illustrated figures herein, GUI 450, 500, and 550 are generally implemented in the context of a GUI "window". Note that in computing, a GUI window is generally a visual area containing some type of user interface (e.g., GUI 153). Such a "window" usually (but not always) possesses a rectangular shape, and displays the output of and may allow input to one or more processes. Such windows are primarily associated with graphical displays, where they can be manipulated with a mouse cursor such as, for example, the pointing device 105 depicted in FIG. 1. A GUI using windows as one of its main "metaphors" is often referred to as a windowing system.

The GUI windows 450, 500, and/or 550 described herein may be arranged in a unique manner to illustrate the status of toxic gas concentrations within the particular location. Such a GUI, associated with the location manager module 252, may provide alerts with respect to the gas concentration conditions within a particular location, such as an industrial plant or facility. For example, each GUI 450, 500, and/or 550 may be utilized by the operator(s) 251 of such a facility to effectively access the location manager module 252 and become aware of location information associated with the hazardous gas event, along with time information. The operator 251 may utilize each GUI 450, 500, and/or 550 to manipulate data, view live messages, view stored messages, define device groups, and transmit messages to other external systems 264 and HILS systems 262.

The GUI 450 generally displays detailed information 460 about the particular facility and a sensor list 470, which includes data about the gas detector unit(s) 256 located within a particular location. The mode of operation of the gas detector unit 256 such as, for example, an alarm mode, a fault mode, or a normal mode and so forth, may be indicated by graphically displayed windows icons 465 and 475 having varying colors and shapes. If, for example, the operator 251 "zooms" into a particular location, the sensor list 470 includes a listing of gas detector unit 256 that are currently located within the selected location and displays the status of the unit 256.

The GUI 450 also permits a user to determine the origin of an alarm by accessing an icon 485. If the user "clicks" the icon 485, the GUI 450 provides alarm origin area 490 information, which includes data such as, for example, alarm reporting time, area priority data, alarm priority information, and the number of gas detectors within the alarm origin area at the time of the alarm report and at the current time, etc.

The operator 251 may select a different map view option utilizing a graphically displayed drop down box 480. A graphically displayed map includes data indicative of the alarm condition associated with the gas detector unit(s) 256, 258, etc., and a color coding scheme indicative of the gas concentration as a function of the location. Such a map can be displayed via GUI 450. The position of the gas detector unit(s) 256, 258, and the gas concentration and the estimated location of the gas detector unit(s) 256, 258 can also be graphically displayed as a function of time. Additionally, a heat map (e.g., a color coded contour plot of gas concentration over an area) of gas concentration at a particular time derived from the gas detector's device reports may also be graphically displayed via the GUI 450.

Additionally, GUI 450 may display video data that includes a series of images of the gas heat map over a period of time based on the previously detected and stored data. GUI 450 may additionally display a mapping of estimated future gas concentrations where the estimates are based on the previously detected and stored data and, for example, the movement of gas concentration over time and the wind conditions. The operator 251 can therefore take advantage of the GUI 450 to effectively access the concentration levels of the toxic gases and location information reported from the gas detector unit(s) 256, 258.

Figure 11:
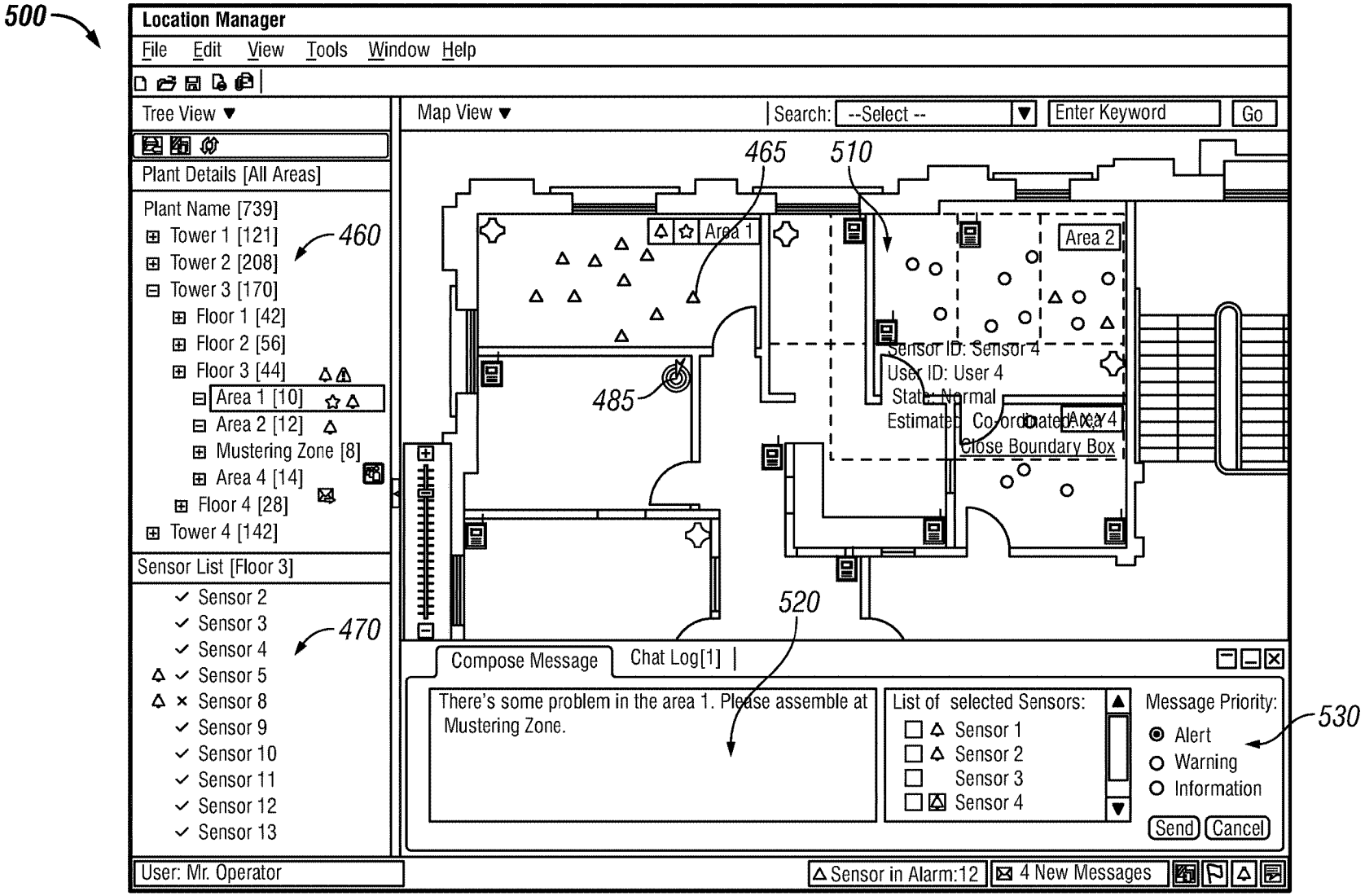
FIG. 11 illustrates a GUI of the location manager illustrating a boundary region associated with a sensor, in accordance with the disclosed embodiments.

FIG. 11 illustrates a diagram of a GUI 500 associated with the location manager module 252 and depicting a boundary region, in accordance with the disclosed embodiment. If the operator 251 "clicks" on a gas detector unit 256 graphically displayed in the sensor list 470, a graphically displayed boundary box 510 that includes a sensor ID, a user ID, the state of the device, and the estimated coordinates associated with the selected gas detector unit 256 is also graphically displayed via GUI 500. Given the possibility of error in location, the boundary box may indicate the area over which the actual location may exist. The GUI 500 may include a graphically displayed message box 520 that includes GUI controls that permit an operator 251 to send text messages between the location manager module 252 and the gas detector unit 256 for use by operator 260. A graphically displayed compose message tab can also be selected, which permits a user to input a message and transmit the messages to a set of selected gas detector operators 260. The message box 520 may further include a message priority 530 that indicates a priority of messages sent by the operator 251. The message box 520 may further depict messages sent from the gas detector unit 256 as initiated by the operator 260.

Figure 12:
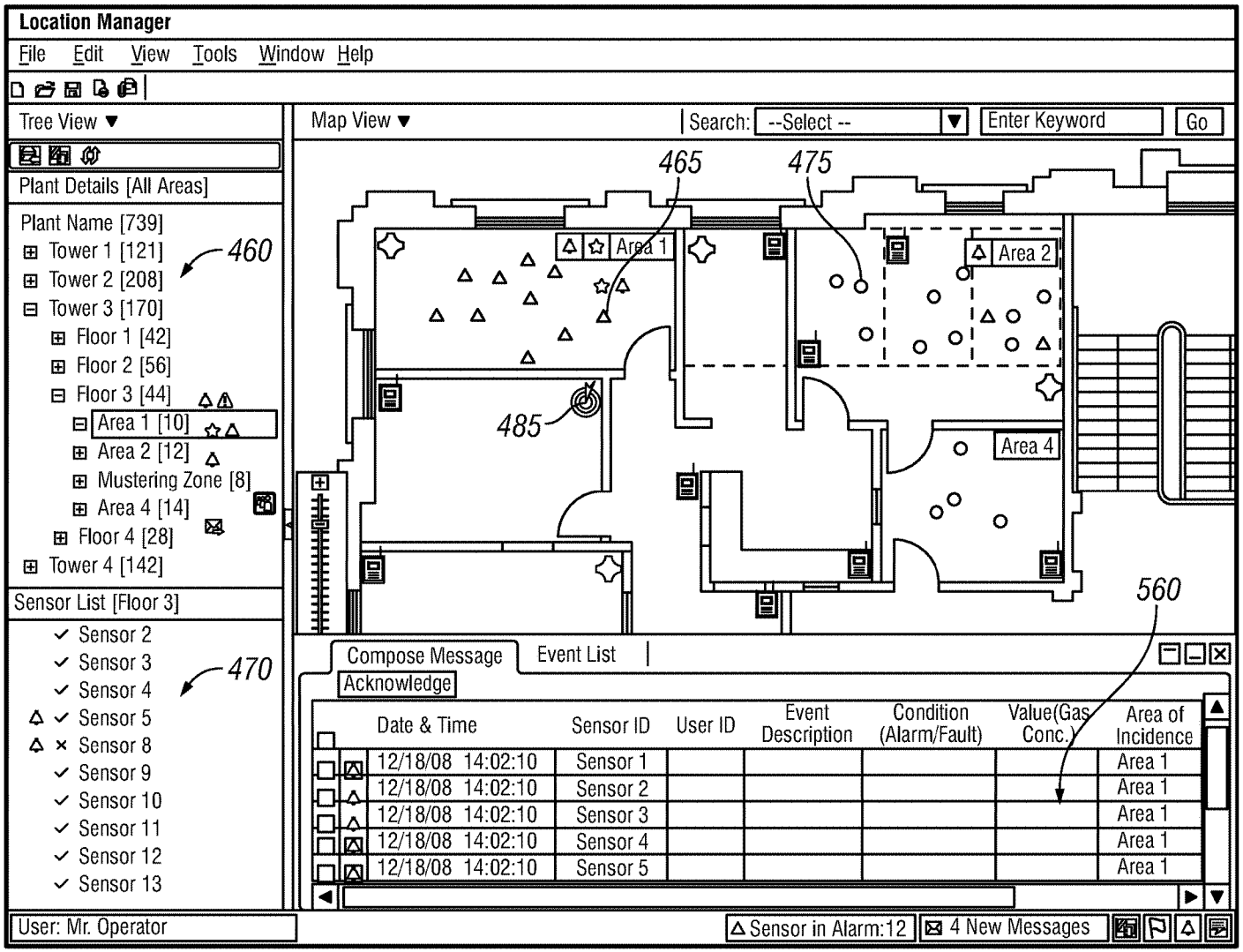
FIG. 12 illustrates a GUI of the location manager illustrating status of active alarms, in accordance with the disclosed embodiments.

FIG. 12 illustrates a diagram of a GUI 550 associated with the location manager module 252 and indicating the status of active alarms, in accordance with the disclosed embodiments. The active alarm list 560 may provide information associated with the gas detector unit(s) 256 that are, or have been, in an active alarm state. The active alarm list 560 also provides data and time information of the alarm generated, a gas detector ID, user ID, event description, area of incident, area priority, and alarm state. The gas detector may change the reporting interval to a shorter time under alarm conditions. The graphical user interface 450, 500, and 550 associated with the location manager module 252 generates various views with respect to the information stored into the database 308 upon request by a user. Note that another advantage of the use of GUI 550 involves a mustering scenario, wherein, for example, all employees are verified to be at a safe "mustering" location via the disclosed location tracking mechanism. A mustering display can, for example, indicate the number of gas detectors in various "zones" or defined areas. An operator can view all gas detectors in one or more mustering zones. An operator can also search for any zone that indicates a hazardous gas in order to verify that the gas detector count in that particular zone is, for example, a value of "0".

Figure 13:
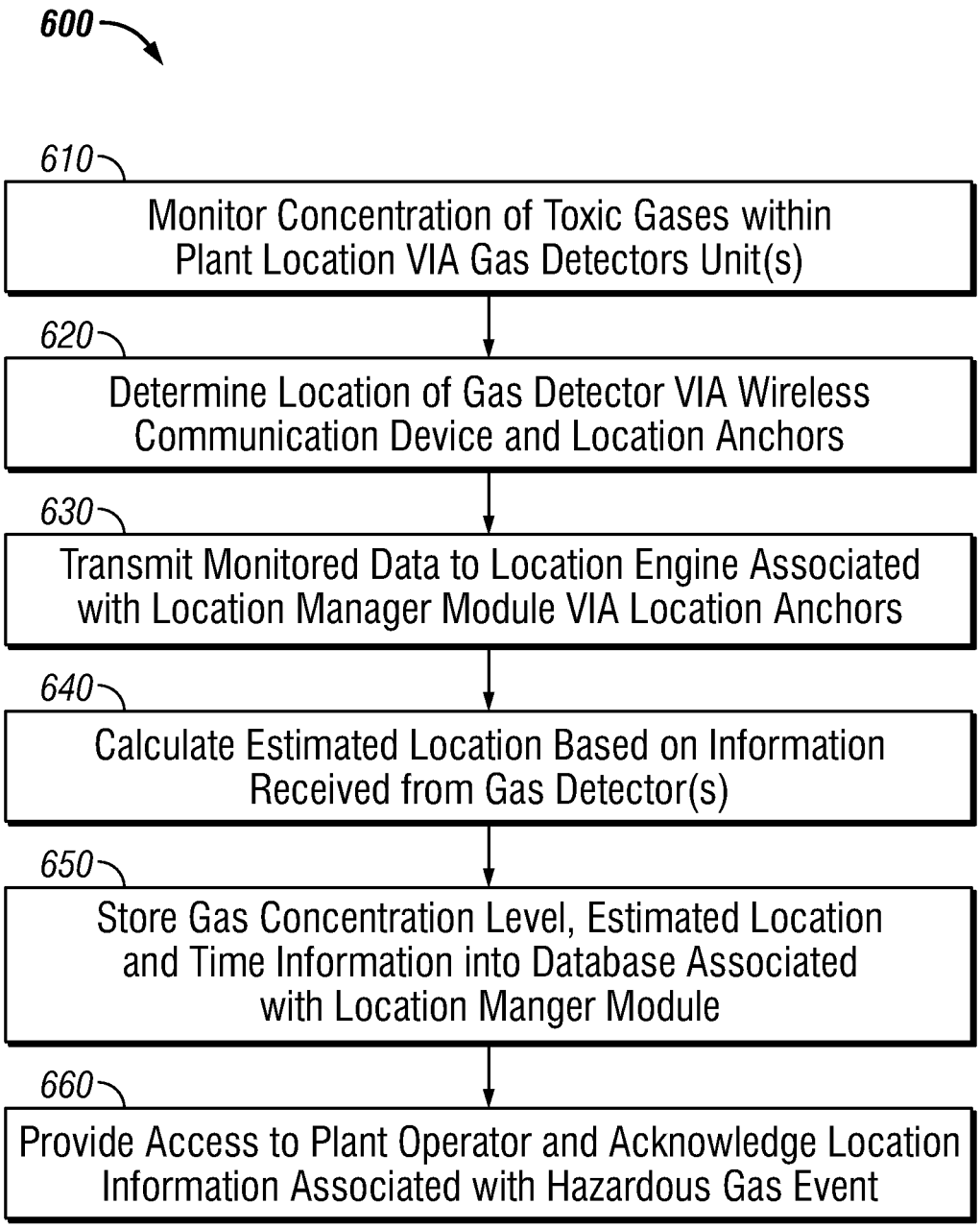
FIG. 13 illustrates a detailed flow chart depicting logical operations of a method for detecting location information associated with a hazardous gas event along with time information, in accordance with the disclosed embodiments.

FIG. 13 illustrates a detailed flow chart of operation illustrating logical operational steps of a method 600 for detecting location information associated with a hazardous gas event along with time information, in accordance with the disclosed embodiments. Note that the method 600 can be implemented in the context of a computer-useable medium that contains a program product, including, for example, a module or group of modules. The concentration of toxic gases within a location can be monitored via the gas detector unit 256, as illustrated at block 610. Further, the location of the gas detector unit(s) 256, for example, can be determined via the location anchor points 276, 277, 278 and 279, as depicted at block 620. The monitored data can be wirelessly transmitted to the location engine 268 associated with the location manager module 252 via the location anchors points that may support Wi-Fi access point service, as indicated at block 630.

As depicted thereafter at block 640, an operation can be processed for calculating location based on information received from the gas detector unit 256 and/or other gas detector devices 258. Next, as indicated at block 650, the gas concentration level, the estimated location, and time information can be stored in a database associated with the location manager module 252. Thereafter, the operator 251 can effectively access the location manager module 252 and become aware of the location information associated with the hazardous gas event along with time information, as indicated at block 660. The operator 251 can therefore effectively access the concentration levels of toxic gases and location information reported from the gas detector unit 256.

Figure 14:
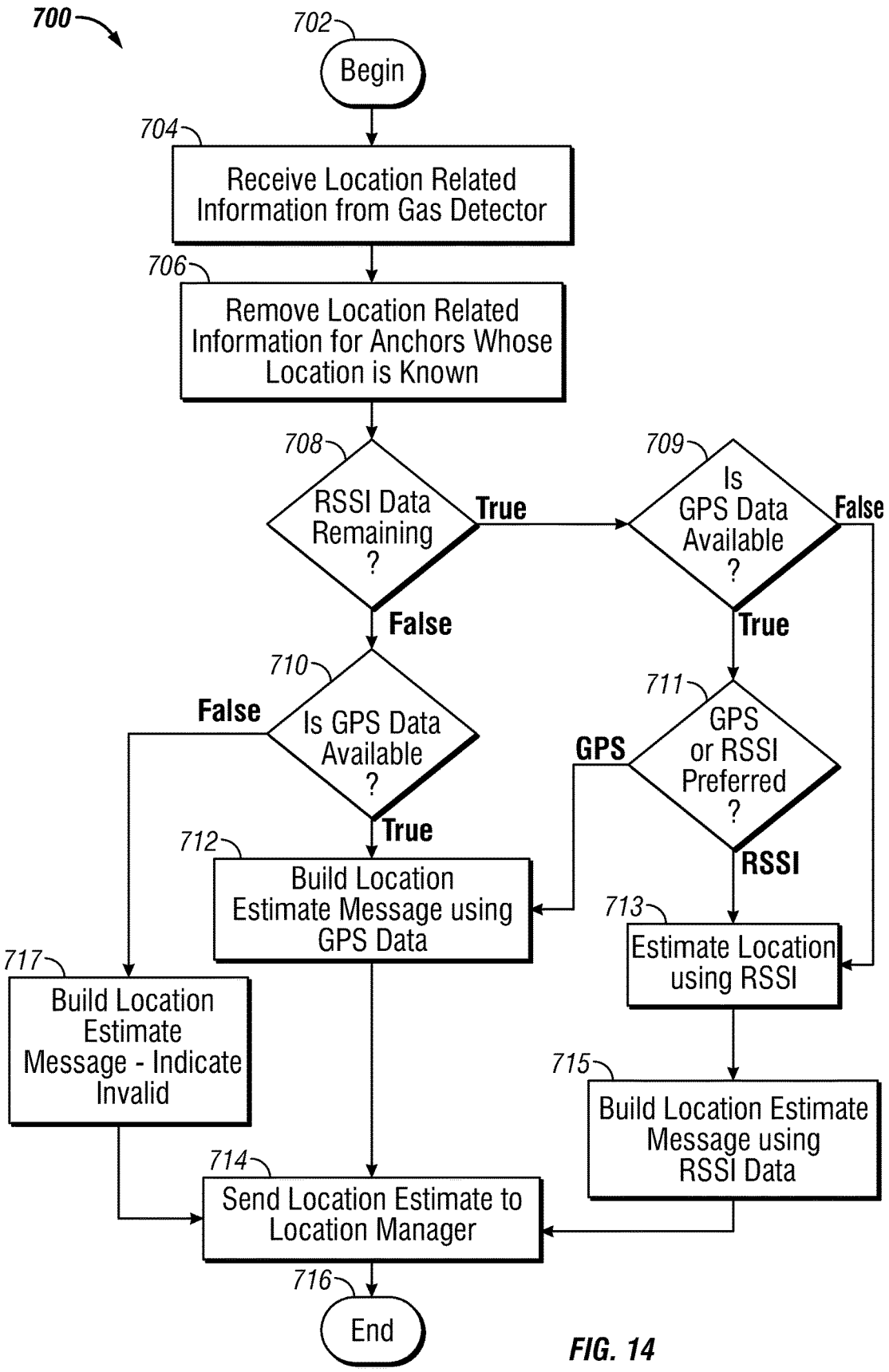
FIG. 14 illustrates a flow chart depicting logical operations of a method for operating a location engine, in accordance with the disclosed embodiments.

FIG. 14 illustrates a flow chart depicting logical operations of a method 700 for operating the location engine 268, in accordance with the disclosed embodiments. As indicated at block 702, the process begins. Next, as described at block 704, location related information can be received from the gas detector unit(s) 256 and/or 258. Thereafter, as described at block 706, location related information associated with location anchors whose location is unknown can be removed. Then, as indicated at block 708, a test can be performed to determine if received signal strength indication (RSSI) data remains. If the answer is "True," then as indicated at block 709, a test can be performed to determine if GPS data is available. If GPS data is not available, then as indicated at block 713, an operation can be performed to estimate location using RSSI data. Assuming the answer, in response to the operation depicted at block 709 is "True," then a test can be performed to determine if GPS or RSSI is preferred, as indicated at block 711. If the answer is GPS, then the operation indicated at block 712 is performed. That is, as indicated at block 712, the location estimate message can be built using GPS data. If the answer in response to the operation indicated at block 711, however, is RSSI, then the operation illustrated at block 713 is performed. Following processing of the operation depicted at block 713, an operation can be performed, as indicated at block 715, to build a location estimate message using RSSI data. Thereafter, the location estimate can be sent to the location manager module 252 as indicated at block 714. The process can then terminate, as depicted at block 716.

Assuming the response to the operation indicated at block 708 is "False," then the operation illustrated at block 710 is processed. That is, as described at block 710, a test can be performed to determine if GPS data is available. Assuming the answer is "True," then the operation indicated at block 712 is processed. That is, as described at block 712, a location estimate message can be built using the GPS data. Then, the operation illustrated at block 714 can be processed and the operations then terminate as indicated at block 716. Assuming that the response to the operation depicted at block 710 is "False," then as indicated at block 717, a location estimate message can be built with a message indicating an "invalid" location estimate. Thereafter, as illustrated at block 714, the location estimate can be sent to the location manager module 252.

Figure 15:
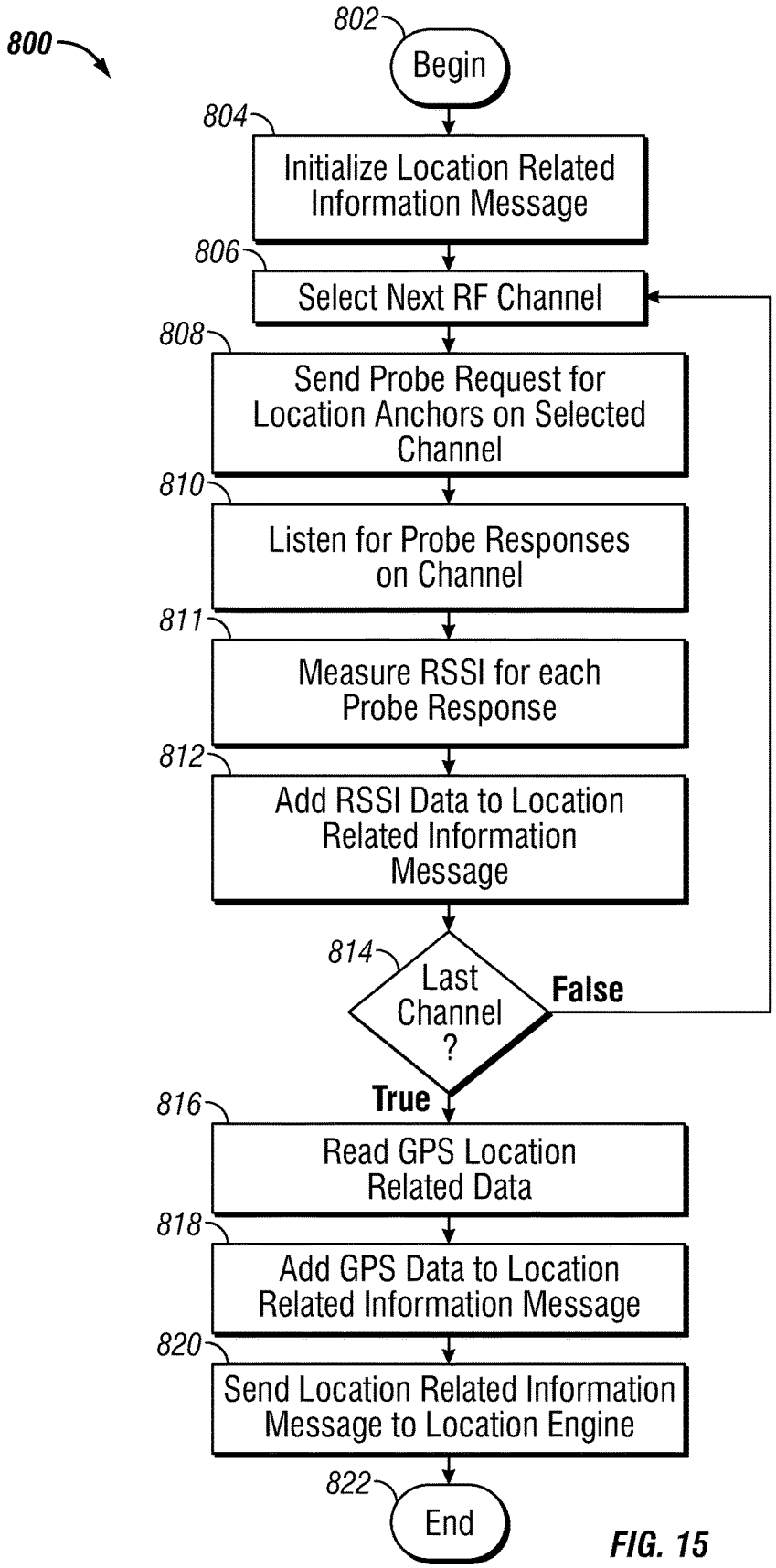
FIG. 15 illustrates a flow chart of operations of a method for gas detector location scanning, in accordance with the disclose embodiments.

FIG. 15 illustrates a flow chart of operations of a method 800 for a gas detector to perform location scanning to acquire the information related to location, in accordance with the disclose embodiments. As indicated at block 802, the process begins. Thereafter, as illustrated at block 804, a location related information message can be initialized. Then, as described at block 806, the next RF channel can be selected. Next, as depicted at block 808, a probe request for location anchors on selected RF channels can be sent. Thereafter, as illustrated at block 810, an operation to "listen" for probe responses on an RF channel can be performed. Next, as described at block 811, measurement of the RSSI for each probe response can be made. Then, as illustrated at block 812, RSSI data can be added to the location related information message. Thereafter, as described at block 814, a test can be performed to determine if the last RF channel has been scanned. If the answer is "False," then the operations beginning, as depicted at block 806 and so forth, are repeated. If the answer is "True," then the GPS location related data is read, as indicated at block 816. Thereafter, the GPS data can be added to the location related information message, as indicated at block 818. Finally, as indicated at block 820, the location related information message can be sent to the location engine 268, Note that an example of such a message is message 265 depicted in FIG. 5. The process ends as illustrated at block 822.

Based on the foregoing, it can be appreciated that, in accordance with the disclosed embodiments, the methods and systems can be implemented for reporting the detection of a hazardous or a non-hazardous condition. Such an approach generally includes: detecting data related to a presence or absence of a hazardous condition and data related to a location of a detection of the presence or absence of the hazardous condition; communicating the data to one or more servers; and recording the data in a database associated with the server(s) for subsequent retrieval, display, and review for use in detecting the hazardous or non-hazardous condition. Additionally, in some embodiments of such a method, steps can be implemented for retrieving a particular subset of such data and the displaying the particular subset of the data. Note that such particular subsets can include "temporal" or "spatial" oriented subsets.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A method for reporting the detection of a potentially hazardous condition, the method comprising:

preconfiguring data into a portable detector, the data comprising at least one of a detector device ID;

measuring, by the portable detector, data related to a presence or an absence of the potentially hazardous condition in a location;

measuring, by the portable detector, information including the received RF signal strength level from RF signals received from a plurality of location anchors at the location, wherein the plurality of location anchors are stationary;

sending the data related to the presence or absence of the potentially hazardous condition and the information including the received RF signal strength level from the RF signals received from the plurality of location anchors at the location to at least one server via a location anchor of the plurality of location anchors that includes an access point function, wherein the at least one server comprises pre-configured location anchor data comprising geographic coordinates for each location anchor of the plurality of location anchors and an RF transmission power tier each location anchor of the plurality of location anchors;

estimating a geographic position of the location based on the information including the received RF signal strength level from RF signals received from the plurality of location anchors at the first location, the geographic coordinates for each location anchor of the plurality of location anchors, and the RF transmission power for each location anchor of the plurality of location anchors; and recording the estimated geographic position and the data related to the presence or the absence of the potentially hazardous condition in the estimated geographic position in a database associated with the at least one server for subsequent retrieval, display, and review for use in detecting the presence or the absence of the potentially hazardous condition.

2. The method of claim 1, further comprising:

retrieving a particular subset of the data related to the potentially hazardous condition, the subset comprising gas detection status information and the estimated geographic position related to the presence or the absence of the potentially hazardous condition in the location; and displaying the particular subset of said potentially hazardous condition, the subset comprising the gas detection status information and the geographic position related to the presence or the absence of the potentially hazardous condition in the location.

3. The method of claim 2, further comprising:

measuring the data related to the presence or the absence of the potentially hazardous condition in the location utilizing a gas detector, wherein the gas detector periodically reports a gas concentration level to the at least one server; and creating a heat map of the potentially hazardous condition if the potentially hazardous condition is present, wherein the heat map comprises a color-coded contour plot of gas concentrations over an area inclusive of the estimated geographic position at a particular time.

4. The method of claim 1, further comprising:

estimating the geographic position of the detection of the potentially hazardous condition including longitude and latitude coordinates by receiving signals from a global navigation satellite system; and sending, to the at least one server, the estimated geographic position.

5. The method of claim 1, wherein the data related to the presence or the absence of the potentially hazardous condition in the location is based on a measurement of a wireless RF signal strength level received at a location anchor of the plurality of location anchors; and wherein estimating the geographic position of the location is further based on the measurement of the wireless RF signal strength level received at the location anchor.

6. A system for porting the detection of a potentially hazardous condition, the system comprising:

at least one portable device configured to measure a presence or an absence of the potentially hazardous condition and generate a measurement thereof, wherein the at least one portable device is further configured to measure information related to a location including a received RE signal strength level from RF signals received from a plurality of location anchors, wherein the at least one portable device is further configured to send data related to the presence or absence of the potentially hazardous condition and the information elated to the location to at least one server via a location anchor of the plurality of location anchors that includes an access point functionality, wherein the at least one portable device is preconfigured with data comprising device ID;

the at least one location anchor of the plurality of location anchors with the access point functionality, wherein the at least one location anchor is configured to wirelessly communicate with the at least one portable device to receive the measurement information and the information related to the location and forward both to the at least one server;

at least one location engine configured to receive information related to the location of the at least one portable device, wherein the at least one server comprises pre-configured location anchor data comprising geographic coordinates for each location anchor of the plurality of location anchors and an RF transmission power for each location anchor of the plurality of location anchors, and wherein the at least one location engine is further configured to calculate an estimated geographic position of the location of the at least one portable device based on the information related to the location of the at least one device, the pre-configured location anchor data, and the RF transmission power for each location anchor of the plurality of location anchors; and the at least one server for collecting, logging, and displaying server data, the server data comprising the information related to the measurement of the presence or the absence of the potentially hazardous condition and the estimated geographic position of the location.

7. The system of claim 6, wherein the server data further comprises a location time associated with a time that the information related to the location was generated and a measurement time associated with a time of the measurement of the presence or the absence of the potentially hazardous condition.

8. The system of claim 6, wherein the plurality of location anchors are configured to communicate wirelessly with the at least one portable device.

9. The system of claim 8, wherein at least one location anchor of the plurality of location anchors comprises at least one receiver.

10. The system of claim 8, wherein the information related to the location further includes location anchor identification information;

wherein the at least one portable device is configured to send the information related to the location wirelessly by the at least one portable device to the at least one location anchor with access point functionality; and wherein the at least one server is configured to plots a heat map of the hazardous condition if the potentially hazardous condition is present, wherein the heat map comprises a color-coded contour plot of gas concentrations over the geographic position at a particular time.

11. The system of claim 10, wherein the at least one portable device is configured to estimate a global location of at least one portable device including at least longitude and latitude coordinates by receiving signals from a global navigation satellite system, and wherein the information related to the location further comprises an estimate of the global location of the at least one portable device.

12. The system of claim 8, wherein:

the at least one location anchor with access point functionality comprises a receiver, and wherein the at least one location anchor with the access point functionality is configured to measure a wireless received signal strength level of at least one signal from the at least one portable device, and wherein the at least one signal includes device identification information associated with the at least one portable device; and the information related to the location comprises a measured received signal strength level and identification information for the at least one portable device and identification information for the at least one location anchor.

13. The system of claim 6, wherein the at least one portable device includes time stamp information corresponding to a time of the measurement of the presence or the absence of the hazardous condition, and wherein the information related to the measurement further comprises the time stamp information.

14. The system of claim 6, wherein the at least one portable device is configured to periodically report the information related to the measurement and the information related to the location and receive an acknowledgement from the at least one server with respect to at least a subset of the reports.

15. The system of claim 6, wherein said at least one portable device is configured to periodically report the information at a particular reporting interval and change a reporting interval to a shorter interval when the hazardous condition is detected.

16. The system of claim 14, wherein the at least one portable device is further configured to:

temporarily log-in the report information in the at least one portable device if the report is not acknowledged by the at least one server, wherein the at least one portable device continues to periodically send a report; and send the logged information to the at least one server when access to the at least one server is confirmed by an acknowledgement received with respect to a report.

17. The system of claim 6, wherein the at least one location anchor with the access point functionality is configured to at least one of:

receive and response to a probe request as specified in IEEE Std 802.11-2007; or generate a beacon frame as specified in IEEE Std 802.11-2007.

18. The system of claim 6, wherein the at least one portable device and the at least one server are configured to transmit text messages in at least one direction between the at least one server and the at least one device.

19. The system of claim 6, wherein the at least one portable device includes a battery configured to provide electrical power to the at least one portable device, wherein the at least one portable device is configured to not perform actions necessary to provide information related to a location when the at least one portable device detects a lack of motion.

20. The system of claim 7, wherein the at least one portable device includes time stamp information corresponding to a time of the measurement of the presence or the absence of the hazardous condition, and wherein the information related to the measurement further comprises the time stamp information; and wherein the at least one portable device is configured to periodically report the information related to the detection and the information related to a location and receive an acknowledgement from the at least one server with respect to at least a subset of the reports.

21. The system of claim 6, wherein the at least one location engine is resident in the at least one device, and wherein the at least one location engine is configured to prepare data indicative of location estimates.

22. The method of claim 1, further comprising: measuring a time of flight of a wireless RF signal between at least one location anchor of the plurality of location anchors and the portable detector; and wherein estimating the geographic position of the location is further based on the measurement of the time of flight.

23. The method of claim 2, wherein displaying the particular subset of the data further comprises graphically and interactively displaying the data via a GUI for a user.

24. The method of claim 23, further comprising: graphically displaying via the GUI, an icon that when selected, generates alarm origin area information, including at least one of: an alarm reporting time, area priority data, alarm priority information, a number of gas concentration detectors within the alarm origin area at the time of alarm, and a number of gas concentration detectors within the alarm origin area at the current time.

25. The method of claim 23, further comprising:

graphically displaying via the GUI, the estimated geographic position of the location of the portable detector and the data related to the presence or the absence of the potentially hazardous condition measured by the portable detector as a function of time.

26. The method of claim 23, further comprising graphically displaying via the GUI, a heat map of gas concentration at a particular time derived from the data reported to the at least one server, wherein the heat map comprises a color-coded contour plot of gas concentrations over an area inclusive of the estimated geographic position of the location at a particular time.

27. The method of claim 26, further comprising graphically displaying via the GUI, a time series of the heat maps.

28. The method of claim 26, further comprising graphically displaying via the GUI, data that includes images of said heat maps indicative of a future time in association with a mapping of predicted gas concentrations, wherein the predicted gas concentrations are based, at least in part, on the data reported to the at least one server.

* * * * *